US005973714A

United States Patent [19]

Yoshikawa et al.

[11] Patent Number: 5,973,714

[45] Date of Patent: Oct. 26, 1999

[54] THERMAL PRINTING APPARATUS USING INTERMEDIATE MEDIUM

[75] Inventors: Masanori Yoshikawa, Osaka; Atsushi Sogami, Sanda; Hiroyuki Matsuo, Osaka; Nobuyoshi Taguchi, Ikoma, all of Japan

[73] Assignee: Matsushita Electric Industrial Co., Ltd., Osaka, Japan

[21] Appl. No.: 08/941,636

[22] Filed: Sep. 30, 1997

Related U.S. Application Data

[62] Division of application No. 08/403,613, Mar. 14, 1995, Pat. No. 5,708,467.

[30] Foreign Application Priority Data

Mar. 15, 1994 [JP] Japan ..... 6-044257
Jun. 21, 1994 [JP] Japan ..... 6-138993

[51] Int. Cl.[6] ..... B41J 2/325

[52] U.S. Cl. ..... 347/213

[58] Field of Search ..... 347/171, 213; 400/120.01

[56] References Cited

U.S. PATENT DOCUMENTS 5,284,814 2/1994 Taguchi et al. .
5,398,051 3/1995 Fukui et al. ..... 347/213

FOREIGN PATENT DOCUMENTS 4141486 5/1992 Japan .

*Primary Examiner*—Huan Tran
*Attorney, Agent, or Firm*—Lowe Hauptman Gopstein Gilman & Berner

[57] ABSTRACT

A thermal printing apparatus includes an intermediate medium. A color developing layer transfer member includes a first base member and a color developing layer on a surface of the first base member. A dye layer transfer member includes a second base member and a dye layer on a surface of the second base member. The dye layer contains dye. At least a part of the color developing layer is transferred from the color developing layer transfer member onto the intermediate medium in response to at least one of heat and pressure. The dye is transferred from the dye layer of the dye layer transfer member onto the color developing layer on the intermediate medium to form a recorded picture on the color developing layer in response to both heat and pressure while the dye layer on the dye layer transfer member and the color developing layer on the intermediate medium are in contact with each other. The color developing layer with the recorded picture is transferred from the intermediate medium onto an image receptor. A releasing device is operative for implementing separation between the intermediate medium and one of the color developing layer transfer member and the dye layer transfer member. The releasing device includes a releasing blade and a belt support member associated with the releasing blade. The releasing blade engages one of the color developing layer transfer member and the dye layer transfer member. The belt support member supports the intermediate medium along one of a flat plane or an outwardly-projecting plane.

36 Claims, 16 Drawing Sheets

THERMAL PRINTING APPARATUS USING INTERMEDIATE MEDIUM

This application is a division of application Ser. No. 08/403,613 filed Mar. 14, 1995, U.S. Pat. No. 5,708,467.

BACKGROUND OF THE INVENTION

1. Field of the Invention

This invention generally relates to a thermal transfer printing apparatus using an intermediate medium. This invention particularly relates to a thermal transfer printing apparatus of the sublimation type which uses the sublimation or the diffusion of dyes in response to heat.

2. Description of the Prior Art

Some of color thermal transfer printing apparatuses are of the sublimation type which use the sublimation or the diffusion of dyes in response to heat. Generally, such a color sublimation-type printing apparatus requires an exclusive recording paper previously provided with a color developing layer.

There have been demands for the printing of a color image on a plain paper other than an exclusive recording paper.

Japanese published unexamined patent application 4-141486 discloses the thermal transfer recording of a color picture on a plain paper. According to the disclosure by Japanese application 4-141486, a dyeing-layer transfer body is held between a recording intermediate and a thermal head, and a dyeing layer is thermal-transfer-recorded onto a mold release layer of the recording intermediate. In addition, the sublimating dye of a coloring material layer on a dye transfer body is thermal-diffusion-transferred into the dyeing layer recorded on the recording intermediate by using the dye transfer body and another thermal head. Lastly, a picture recorded in the dyeing layer on the recording intermediate is thermally transferred onto an image-receiving body together with the dyeing layer by using a thermal roller. Thus, a high-quality picture is acquired by dye thermal transfer recording without depending upon the substrate of the image-receiving body. Excellent recording is often conducted when the speeds of travel of the dye transfer body and the recording intermediate are separately controlled. The speed of travel of the dyeing-layer transfer body is often controlled also apart from the speed of travel of the recording intermediate.

U.S. Pat. No. 5,284,814 also discloses the thermal transfer recording of a color picture on a plain paper. According to the disclosure by U.S. Pat. No. 5,284,814, a dyeing layer transfer member has a dyeing layer on a base material, and an ink transfer member has an ink layer containing a subliming dye on a base material. The dyeing layer of the dyeing layer transfer member is thermally transferred onto a recording intermediate member. Ink of the ink transfer member is thermally transferred and recorded onto the transferred dyeing layer in accordance with image signals. The recorded dyeing layer is thermally transferred onto an image receptor.

SUMMARY OF THE INVENTION

It is an object of this invention to provide an improved thermal transfer printing apparatus using an intermediate medium.

A first aspect of this invention provides a thermal printing apparatus for printing a recorded picture on an image receptor which comprises an intermediate medium having an endless shape; a color developing layer transfer member including a first base member and a color developing layer on a surface of the first base member; a dye layer transfer member including a second base member and a dye layer on a surface of the second base member, the dye layer containing dye; first means for transferring at least a part of the color developing layer from the color developing layer transfer member onto the intermediate medium in response to at least one of heat and pressure; second means for transferring the dye from the dye layer of the dye layer transfer member onto the color developing layer on the intermediate medium to form a recorded picture on the color developing layer in response to both heat and pressure while contacting the dye layer on the dye layer transfer member and the color developing layer on the intermediate medium with each other; third means for transferring the color developing layer with the recorded picture from the intermediate medium onto the image receptor; and fourth means, located at a place downstream of at least one of the first means and the second means as viewed in a direction of movement of the intermediate medium, for implementing separation between the intermediate medium and at least one of the color developing layer transfer member and the dye layer transfer member; wherein the fourth means comprises a releasing blade and a belt support member associated with the releasing blade, the releasing blade engaging at least one of the color developing layer transfer member and the dye layer transfer member, the belt support member supporting the intermediate medium along one of a flat plane or an outwardly-projecting plane.

In the first aspect of this invention, it is preferable that the releasing blade has a corner contacting with at least one of the color developing layer transfer member and the dye layer transfer member, and the belt support member has a curved surface which supports the intermediate medium along an outwardly-projecting plane.

In the first aspect of this invention, it is preferable that the releasing blade has a flat portion adjoining the corner and guiding at least one of the color developing layer transfer member and the dye layer transfer member at a given releasing angle from the intermediate medium, the given releasing angle being in a range between 45 degrees and 90 degrees or a range between 60 degrees and 90 degrees.

In the first aspect of this invention, it is preferable that the releasing blade is located at a position which enters a normal place of at least one of the color developing layer transfer member and the dye layer transfer member toward the intermediate medium by a distance of 0.5 mm when the recorded picture is formed on the color developing layer.

In the first aspect of this invention, it is preferable that the belt support member includes a resilient member.

In the first aspect of this invention, it is preferable that the belt support member is fixed and has a contacting surface on which the intermediate medium slides.

In the first aspect of this invention, it is preferable that the intermediate medium includes an endless belt and a surface layer provided on an outer surface of the endless belt, the endless belt being made of polyimide, the surface layer being made of fluorine rubber.

In the first aspect of this invention, it is preferable that the first means and the second means are common.

A second aspect of this invention provides a thermal printing apparatus for printing a recorded picture on an image receptor which comprises an intermediate medium having an endless shape; a color developing layer transfer member including a first base member and a color developing layer on a surface of the first base member; a dye layer transfer member including a second base member and a dye layer on a surface of the second base member, the dye layer containing dye; first means for transferring at least a part of the color developing layer from the color developing layer transfer member onto the intermediate medium in response to at least one of heat and pressure; second means for transferring the dye from the dye layer of the dye layer transfer member onto the color developing layer on the intermediate medium to form a recorded picture on the color developing layer in response to both heat and pressure while contacting the dye layer on the dye layer transfer member and the color developing layer on the intermediate medium with each other; third means for transferring the color developing layer with the recorded picture from the intermediate medium onto the image receptor; and fourth means, located at a place downstream of at least one of the first means and the second means as viewed in a direction of movement of the intermediate medium, for implementing separation between the intermediate medium and at least one of the color developing layer transfer member and the dye layer transfer member; wherein the fourth means comprises a releasing blade which supports at least one of the color developing layer transfer member and the dye layer transfer member at a position contacting with or separating from the intermediate medium and between two guide members supporting the intermediate medium.

In the second aspect of this invention, it is preferable that the releasing blade has a corner contacting with at least one of the color developing layer transfer member and the dye layer transfer member.

In the second aspect of this invention, it is preferable that the releasing blade has a flat portion adjoining the corner and guiding at least one of the color developing layer transfer member and the dye layer transfer member at a given releasing angle from the intermediate medium, the given releasing angle being in a range between 45 degrees and 90 degrees or a range between 60 degrees and 90 degrees.

In the second aspect of this invention, it is preferable that the intermediate medium includes an endless belt and a surface layer provided on an outer surface of the endless belt, the endless belt being made of polyimide, the surface layer being made of fluorine rubber.

In the second aspect of this invention, it is preferable that the first means and the second means are common.

A third aspect of this invention provides a thermal printing apparatus for printing a recorded picture on an image receptor which comprises an intermediate medium having an endless shape; a color developing layer transfer member including a first base member and a color developing layer on a surface of the first base member; a dye layer transfer member including a second base member and a dye layer on a surface of the second base member, the dye layer containing dye; first means for transferring at least a part of the color developing layer from the color developing layer transfer member onto the intermediate medium in response to at least one of heat and pressure; second means for transferring the dye from the dye layer of the dye layer transfer member onto the color developing layer on the intermediate medium to form a recorded picture on the color developing layer in response to both heat and pressure while contacting the dye layer on the dye layer transfer member and the color developing layer on the intermediate medium with each other; and third means for transferring the color developing layer with the recorded picture from the intermediate medium onto the image receptor; wherein the third means comprises a) a pair of a heating roller and an opposed roller located at inner and outer sides of the intermediate medium respectively; b) fourth means for pressing at least one of the heating roller and the opposed roller against the other via the intermediate medium and the image receptor; c) fifth means for separating the image receptor from the intermediate medium; and d) sixth means located between the roller pair and the fifth means for suppressing waves of the intermediate medium, the sixth means including a belt guide which guides and supports the intermediate medium.

In the third aspect of this invention, it is preferable that the belt guide is located at an inner side of the intermediate medium and is relatively pressed against the intermediate medium.

In the third aspect of This invention, it is preferable that a direction of path of travel of the intermediate medium changes at a position between the heating roller and the opposed roller, and a line connecting centers of the heating roller and the opposed roller is approximately perpendicular to a direction of travel of the intermediate medium in a region following the roller pair.

In the third aspect of this invention, it is preferable that the belt guide and the fifth means are in a single body.

In the third aspect of this invention, it is preferable that the belt guide comprises means for cooling the intermediate medium.

In the third aspect of this invention, it is preferable that the belt guide comprises means for cleaning the intermediate medium.

In the third aspect of this invention, it is preferable that the intermediate medium includes an endless belt and a surface layer provided on an outer surface of the endless belt, the endless belt being made of polyimide, the surface layer being made of fluorine rubber.

In the third aspect of this invention, it is preferable that the first means and the second means are common.

DESCRIPTION OF THE PREFERRED EMBODIMENTS

First Embodiment

Figure 1:
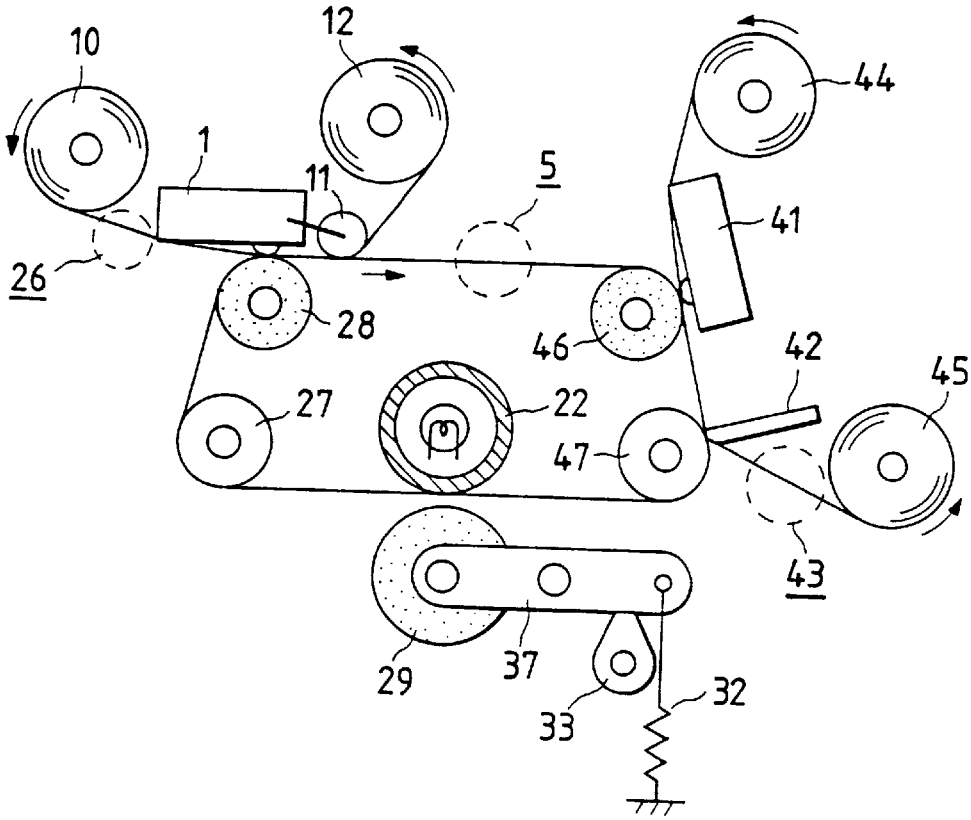
FIG. 1 is a diagram of a thermal transfer printing apparatus according to a first embodiment of this invention.

With reference to FIG. 1, a thermal transfer printing apparatus includes a color developing layer transfer sheet 26, a dye layer transfer sheet 43, and an intermediate medium (an intermediate recording medium) 5.

Figure 2:
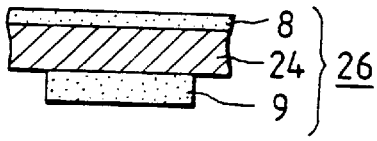
FIG. 2 is a sectional view of a color developing layer transfer sheet in the apparatus of FIG. 1.

As shown in FIG. 2, the color developing layer transfer sheet 26 has a base film (a layer substrate) 24, a heat-resisting and slipping layer 8, and a color developing layer 9. The base film 24 is made of, for example, polyester. The heat-resisting and slipping layer 8 is provided on one side of the base film 24. The color developing layer 9 is provided on the other side of the base film 24.

Figure 3:
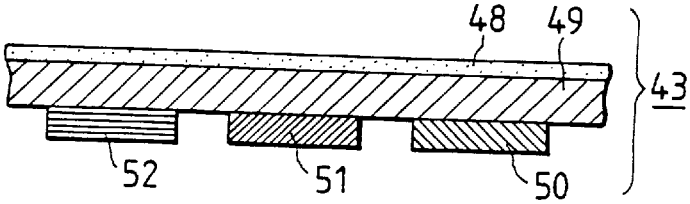
FIG. 3 is a sectional view of a dye layer transfer sheet in the apparatus of FIG. 1.

As shown in FIG. 3, the dye layer transfer sheet 43 has a base film (a layer substrate) 49, a heat-resisting and slipping layer 48, a yellow dye layer 50, a magenta dye layer 51, and a cyan dye layer 52. The base film 49 is made of, for example, polyester. The heat-resisting and slipping layer 48 is provided on one side of the base film 49. The yellow dye layer 50, the magenta dye layer 51, and the cyan dye layer 52 are provided on the other side of the base film 49. The yellow dye layer 50, the magenta dye layer 51, and the cyan dye layer 52 are sequentially arranged in that order.

Figure 4:
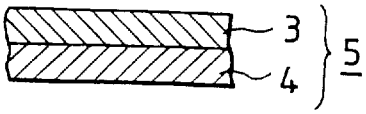
FIG. 4 is a sectional view of an intermediate medium in the apparatus of FIG. 1.

As shown in FIG. 4, the intermediate medium 5 has an endless belt 4 and a surface layer 3. The endless belt 4 includes a polyimide film. The surface layer 3 is provided on the outer side of the endless belt 4. The surface layer 3 is made of fluorine rubber.

With reference back to FIG. 1, the thermal transfer printing apparatus includes a first thermal head 1, a cooling roller 11, a first guide roller 27, and a first platen roller 28. The first thermal head 1 serves as a means for forming a color developing layer. During the formation of a color developing layer, a first urging device (not shown) presses the first thermal head 1 against the first platen roller 28 via the color developing layer transfer sheet 26 and the intermediate medium 5.

The color developing layer transfer sheet 26 extends between a supply roller 10 and a take-up roller 12. The take-up roller 12 is rotated by a drive mechanism (not shown), moving the color developing layer transfer sheet 26 from the supply roller 10 and winding the color developing layer transfer sheet 26.

The thermal transfer printing apparatus of FIG. 1 includes a second thermal head 41 and a second platen roller 46. The second thermal head 41 serves as a means for recording a picture (an image). During the recording of a picture, a second urging device (not shown) presses the second thermal head 41 against the second platen roller 46 via the dye layer transfer sheet 43 and the intermediate medium 5.

The thermal transfer printing apparatus of FIG. 1 includes a releasing blade 42 and a second guide roller 47. The second guide roller 47 supports the intermediate medium 5. During the recording of a picture, a third urging device (not shown) presses the releasing blade 42 against the second guide roller 47 via the dye layer transfer sheet 43 and the intermediate medium 5.

The dye layer transfer sheet 43 extends between a supply roller 44 and a take-up roller 45. The take-up roller 45 is rotated by a drive mechanism (not shown), moving the dye layer transfer sheet 43 from the supply roller 44 and winding the dye layer transfer sheet 43.

The intermediate medium 5 is supported by the first guide roller 27, the first platen roller 28, the second platen roller 46, and the second guide roller 47. The intermediate medium 5 is driven in a direction denoted by the arrow in FIG. 1. The first guide roller 27, the first platen roller 28, the second platen roller 46, and the second guide roller 47 are sequentially arranged in that order along the direction of movement of the intermediate medium 5.

A heating roller 22 is located inside the loop defined by the intermediate medium 5. An opposed roller 29 with respect to the heating roller 22 is located outside the loop defined by the intermediate medium 5. Thus, the intermediate medium 5 extends between the heating roller 22 and the opposed roller 29. The opposed roller 29 is supported on a first end of a lever 37. The lever 37 is rotatable about its center. A spring 32 is provided between a second end of the lever 37 and a fixed support. A rotatable cam 33 engages a portion of the lever 37 near its second end. The lever 37, the spring 32, and the cam 33 compose a mechanism for pressing the opposed roller 29 toward the heating roller 22. Specifically, the force of the spring 32 acts on the opposed roller 29 via the lever 37, pressing the opposed roller 29 against the heating roller 22 via the intermediate medium 5. The cam 33 can be driven by a suitable device (not shown). Rotation of the cam 33 turns the lever 37, moving the opposed roller 29 toward and away from the heating roller 22. The heating roller 22, the opposed roller 29, the lever 37, the spring 32, the cam 33, and the first guide roller 27 compose a transferring means.

Figure 5:
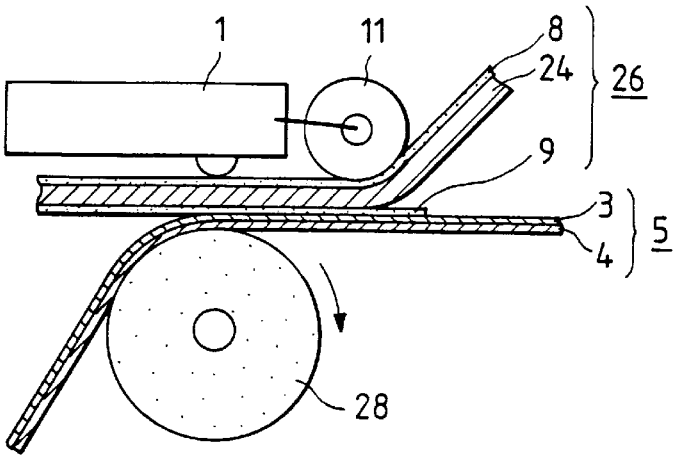
FIG. 5 is a diagram of a portion of the thermal transfer printing apparatus of FIG. 1 in conditions which occur during a process of forming a color developing layer.

The thermal transfer printing apparatus of FIG. 1 operates as follows. FIG. 5 shows an example of conditions of a portion of the thermal transfer printing apparatus which occur during a process of forming a color developing layer.

With reference to FIG. 5, during the color developing layer forming process, the color developing layer transfer sheet 26 is sandwiched between the first thermal head 1 and the intermediate medium 5 so that the color developing layer 9 and the intermediate medium 5 will contact with each other. The first thermal head 1 is energized or activated while the first platen roller 28 is rotated by a drive mechanism (not shown) in a direction denoted by the arrow in FIG. 5. Accordingly, the first thermal head 1 heats the whole of the color developing layer 9 and thereby softens the whole of the color developing layer 9 as the color developing layer transfer sheet 26 advances. Consequently, the whole of the color developing layer 9 has an adhesive force with respect to the intermediate medium 5. The color developing layer transfer sheet 26 successively passes the first thermal head 1 and the cooling roller 11. As the color developing layer transfer sheet 26 travels along the cooling roller 11, the color developing layer transfer sheet 26 separates from the intermediate medium 5.

During the color developing layer forming process, the color developing layer 9 is heated by the first thermal head 1 to a temperature at which an adequate adhesive force occurs. Then, the color developing layer 9 is cooled by the cooling roller 11 to a temperature lower than the flow softening point of bonding resin thereof. In the case where a temperature within the apparatus is relatively low, the temperature of the color developing layer 9 decreases below the flow softening point of the bonding resin thereof before the color developing layer transfer sheet 26 reaches the cooling roller 11. Thus, the whole of the color developing layer 9 is stably transferred onto the intermediate medium 5 without undergoing cohesive destruction. As understood from the previous description, the cooling roller 11 serves as a means for separating the color developing layer 9 from the color developing layer transfer sheet 26 and then transferring the color developing layer 9 onto the intermediate medium 5.

Figure 6:
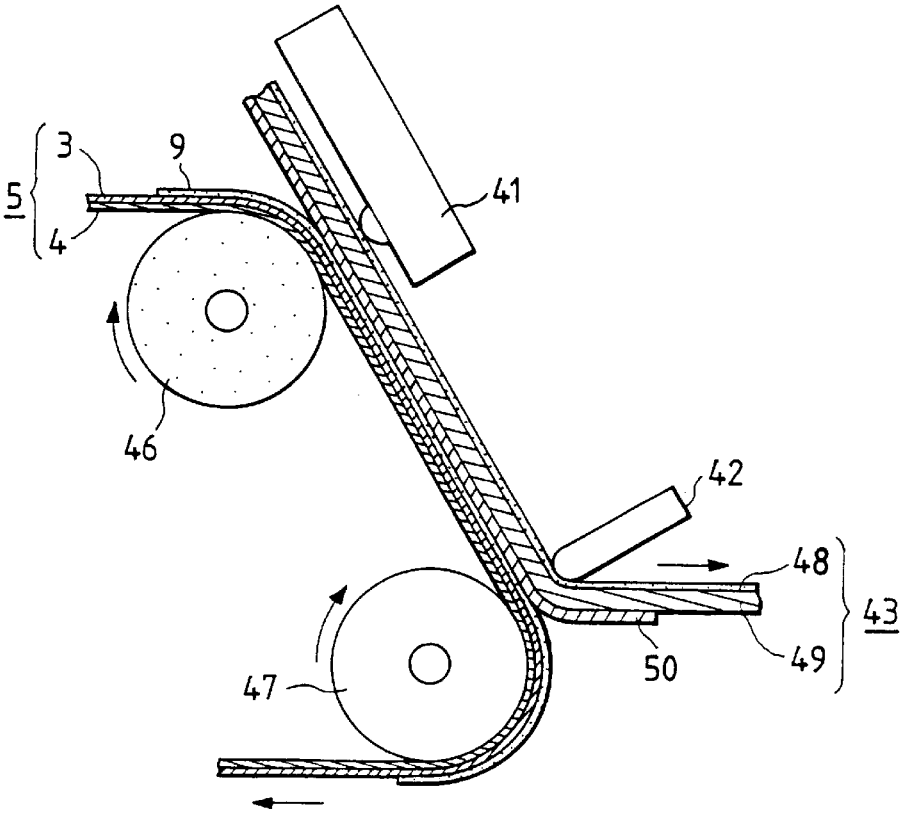
FIG. 6 is a diagram of a portion of the thermal transfer printing apparatus of FIG. 1 in conditions which occur during a process of forming a recorded picture.

FIG. 6 shows an example of conditions of a portion of the thermal transfer printing apparatus which occur during a process of forming a recorded picture (a recorded image). The recorded-picture forming process follows the previously-mentioned color developing layer forming process.

With reference to FIG. 6, during the recorded-picture forming process, the dye layer transfer sheet 43 is sandwiched between the intermediate medium 5 and the second thermal head 41 so that the color developing layer 9 on the intermediate medium 5 and the yellow dye layer 50 on the dye layer transfer sheet 43 will contact with each other. The second thermal head 41 is energized or activated in response to a picture signal (an image signal) while the second paten roller 46 is rotated by a drive mechanism (not shown) in a direction denoted by the arrow in FIG. 6. Accordingly, the second thermal head 41 selectively heats the yellow dye layer 50, thereby transferring yellow dye from heated portions of the yellow dye layer 50 onto the color developing layer 9 and forming a yellow picture on the color developing layer 9. The formed yellow picture depends on the picture signal. After the yellow dye is transferred onto the color developing layer 9, the yellow dye layer 50 on the dye layer transfer sheet 43 and the color developing layer 9 on the intermediate medium 5 are separated from each other. In a region between the releasing blade 42 and the second guide roller 47 which immediately precedes a releasing point, the intermediate medium 5 and the dye layer transfer sheet 43 are sandwiched between the releasing blade 42 and the second guide roller 47. Then, the intermediate medium 5 and the dye layer transfer sheet 43 pass the releasing point. Specifically, as the intermediate medium 5 travels around a part of the second guide roller 47 along an outwardly-projecting path, the intermediate medium 5 separates from the dye layer transfer sheet 43. As the dye layer transfer sheet 43 passes the releasing blade 42, the dye layer transfer sheet 43 is driven along a bent path and is drawn in a direction denoted by the arrow in FIG. 6. The course of the intermediate medium 5 around the second guide roller 47 and the bent path of the dye layer transfer sheet 43 are designed to provide a large releasing angle of the releasing point, that is, a large angle of separation between the intermediate medium 5 and the dye layer transfer sheet 43. It should be noted that, during the color developing layer forming process, the whole of the color developing layer 9 is heated by the first thermal head 1 and is bonded to the surface layer 3 of the intermediate medium 5.

During the recorded-picture forming process, portions of the yellow dye layer 50 which correspond to a picture (an image) to be recorded are heated by the second thermal head 41, and the heated portions of the yellow dye layer 50 are bonded to the color developing layer 9. At the releasing point, the course of the dye layer transfer sheet 43 is bent by the releasing blade 42 and hence the yellow dye layer 50 and the color developing layer 9 separate from each other. Since the releasing point has a large releasing angle as previously described, the yellow dye layer 50 easily and reliably separates from the color developing layer 9. At the same time, the intermediate medium 5 is drawn along a direction away from the course of the dye layer transfer sheet 43. Since the intermediate medium 5 is curved along the second guide roller 47, the intermediate medium 5 stably travels without moving out of engagement with the second guide roller 47 provided that a suitable tension is applied to the intermediate medium 5.

In this way, the yellow-related steps in the recorded-picture forming process are executed. During the recorded-picture forming process, after the yellow-related steps have been completed, magenta-related steps similar to the yellow-related steps and cyan-related steps similar to the yellow-related steps are sequentially executed. As a result, the color developing layer 9 on the intermediate medium 5 is formed with a full color recorded picture.

Figure 7:
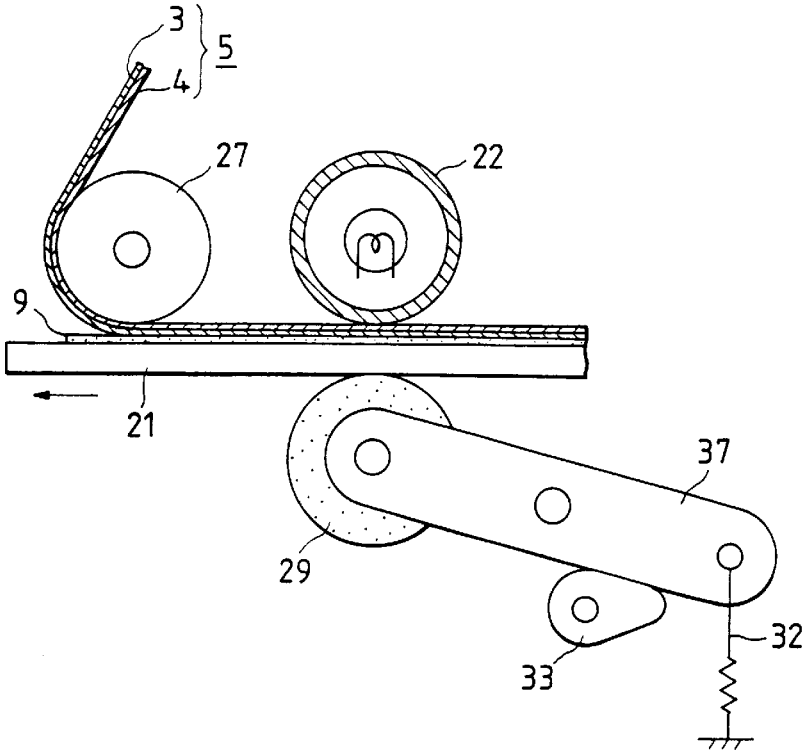
FIG. 7 is a diagram of a portion of the thermal transfer printing apparatus of FIG. 1 in conditions which occur during a transferring process.

FIG. 7 shows an example of conditions of a portion of the thermal transfer printing apparatus which occur during a transferring process. The transferring process follows the previously-mentioned recorded-picture forming process.

With reference to FIG. 7, during the transferring process, the cam 33 is rotated into a position at which the opposed roller 29 is pressed against the heating roller 22 via the intermediate medium 5. The intermediate medium 5 and an image receptor (a picture receptor) 21 are driven through a region between the opposed roller 29 and the heating roller 22 while the color developing layer 9 on the intermediate medium 5 is in contact with the image receptor 21. As previously described, the color developing layer 9 on the intermediate medium 5 has the full color recorded picture. The image receptor 21 includes a plain paper such as a PPC sheet or a postcard. After the intermediate medium 5 passes the heating roller 22, the intermediate medium 5 travels around a part of the first guide roller 27 along a curved path and hence separates from the image receptor 21. During the transferring process, the full color recorded picture is transferred and fixed onto the image receptor 21. Specifically, the color developing layer 9 on the intermediate medium 5 is heated by the heating roller 22 to a temperature at which the color developing layer 9 has an adequate adhesive force with respect to the image receptor 21. Generally, this temperature is equal -to or higher than the flow softening point of the bonding resin in the color developing layer 9. In the case where the image receptor 21 has a rough surface, it is preferable that the color developing layer 9 is heated to a higher temperature. As the color developing layer 9 moves from the heating roller 22 to the first guide roller 27, the color developing layer 9 is cooled to a temperature at which the film cohesive force on the color developing layer 9 is sufficiently stronger than the adhesive force with respect to the surface layer 3 of the intermediate medium 5. Therefore, the color developing layer 9 which has the full color recorded picture is stably transferred and fixed onto the image receptor 21 without undergoing cohesive destruction.

The thermal transfer printing apparatus of FIG. 1 has the following features. The second thermal head 41 serves as the picture recording means. The second guide roller 47 supports the intermediate medium 5. The releasing blade 42 and the second guide roller 47 are located in a region downstream of the second thermal head 41 as viewed in the direction of movement of the intermediate medium 5 and the dye layer transfer sheet 43. The releasing blade 42 and the second guide roller 47 cooperate to implement smooth separation between the intermediate medium 5 and the dye layer transfer sheet 43. Specifically, the intermediate medium 5 travels around a part of the second guide roller 47 along an outwardly-projecting path whereas the dye layer transfer sheet 43 passes the releasing blade 42 along a bent path separating from the path of the intermediate medium 5 at a large releasing angle. Accordingly, even in the case where the temperature of the intermediate medium 5 is relatively high, the dye layer transfer sheet 43 is stably separated from the intermediate medium 5.

The dye layer transfer sheet 43 and the intermediate medium 5 are sandwiched between the releasing blade 42 and the second guide roller 47. This arrangement suppresses the travel of the winding force on the dye layer transfer sheet 43 to a region upstream of the releasing point. Thus, in the region upstream of the releasing point, the color developing layer 9 on the intermediate medium 5 is prevented from receiving an unwanted shearing force. In addition, the color developing layer 9 is fed to the releasing point while the color developing layer 9 maintains an adequate adhesive force with respect to the surface layer 3 of the intermediate medium 5. Accordingly, even in the case where the temperature of the intermediate medium 5 is relatively high, the dye layer transfer sheet 43 is stably separated from the intermediate medium 5.

While the first thermal head 1 serves as the color developing layer forming means in this embodiment, a suitable heating device such as a heating roller, a bar-shaped heater, or a flat-configuration heater may be used as the color developing layer forming means.

The surface layer 3 of the intermediate medium 5 may be adhesive. In this case, the color developing layer 9 can be transferred onto the intermediate medium 5 without being heated. Thus, in this case, the color developing layer forming means may include a pressurizing device such as a roller.

As previously described, the cooling roller 11 serves as a means for separating the color developing layer 9 from the color developing layer transfer sheet 26 and then transferring the color developing layer 9 onto the intermediate medium 5. Alternatively, a releasing blade and a belt support member similar to the releasing blade 42 and the second guide roller 47 may be provided as a means for separating the color developing layer 9 from the color developing layer transfer sheet 26 and then transferring the color developing layer 9 onto the intermediate medium 5.

Second Embodiment

Figure 8:
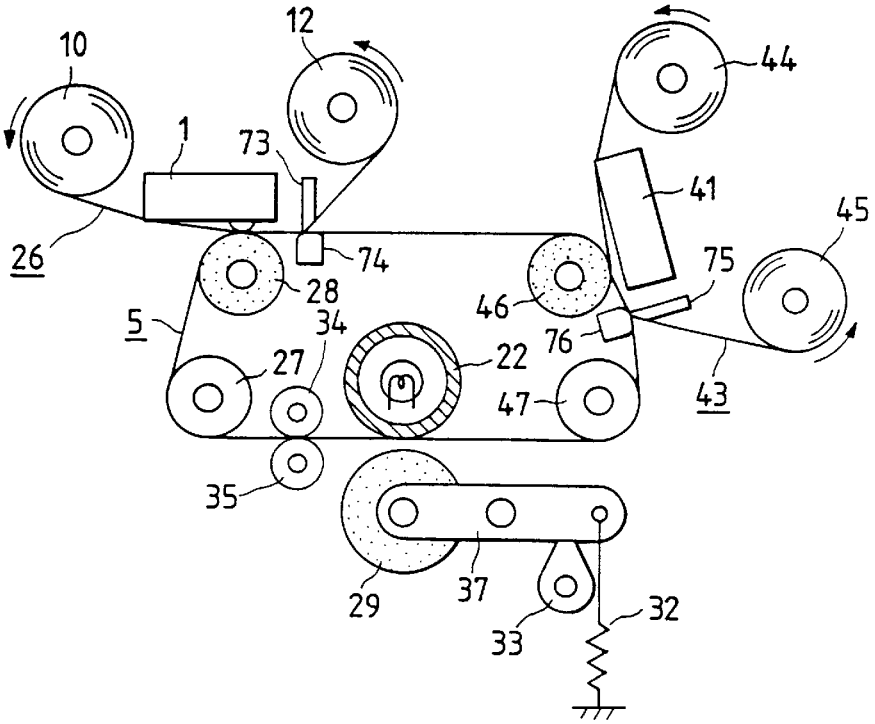
FIG. 8 is a diagram of a thermal transfer printing apparatus according to a second embodiment of this invention.

FIG. 8 shows a thermal transfer printing apparatus according to a second embodiment of this invention. The thermal transfer printing apparatus of FIG. 8 is similar to the thermal transfer printing apparatus of FIG. 1 except for design changes indicated hereinafter.

The thermal transfer printing apparatus of FIG. 8 includes a first releasing blade 73, a first belt support member 74, a second releasing blade 75, and a second belt support member 76. The first releasing blade 73 and the first belt support member 74 compose a releasing or separating means located in a region between a first thermal head 1 and a second thermal head 41. Also, the second releasing blade 75 and the second belt support member 76 compose a releasing or separating means located in a region between the second thermal head 41 and a second guide roller 47. During a color developing layer forming process and a picture recording process, a first urging device (not shown) acts on the first releasing blade 73 together with the first thermal head 1 and presses the first releasing blade 73 against the first belt support member 74 via a color developing layer transfer sheet 26 and an intermediate medium 5. On the other hand, a second urging device (not shown) acts on the second releasing blade 75 together with the second thermal head 41 and presses the second releasing blade 75 against the second belt support member 76 via a dye layer transfer sheet 43 and the intermediate medium 5. The first releasing blade 73 may be mechanically connected to and supported by the first thermal head 1. The second releasing blade 75 may be mechanically connected to and supported by the second thermal head 41. The first and second belt support members 74 and 76 are fixed to a body (not shown) of the apparatus.

The thermal transfer printing apparatus of FIG. 8 includes a pair of belt guides 34 and 35. An urging device (not shown) presses the belt guides 34 and 35 against each other via the intermediate medium 5 in a region between a heating roller 22 and a first guide roller 27. The heating roller 22, an opposed roller 29, a lever 37, a spring 32, a cam 33, the first guide roller 27, and the belt guides 34 and 35 compose a transferring means.

Figure 9:
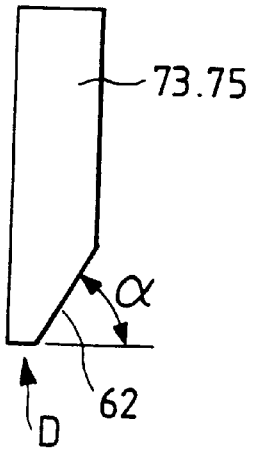
FIG. 9 is a side view of a releasing blade in the apparatus of FIG. 8.

As shown in FIG. 9, each of the releasing blades 73 and 75 has an end corner "D", and a flat inclined surface 62 adjoining the end corner "D". The end corner "D" is designed to define a releasing angle "α" with respect to the color developing layer transfer sheet 26 or the dye layer transfer sheet 43. The releasing angle "α" is equal to the angle between the flat inclined surface 62 and a plane corresponding to the surface of the color developing layer transfer sheet 26 or the dye layer transfer sheet 43.

Figure 10:
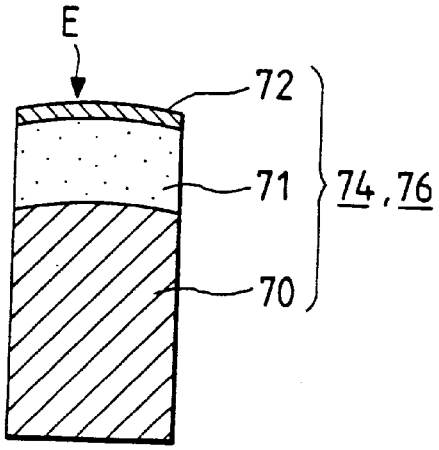
FIG. 10 is a sectional view of a belt support member in the apparatus of FIG. 8.

As shown in FIG. 10, each of the belt support members 74 and 76 includes a base 70, a resilient layer 71, and a slipping layer 72. The resilient layer 71 is provided on the base 70. The slipping layer 72 is provided on the resilient layer 71. The slipping layer 72 has an outwardly-projecting curved surface "E" which abuts against the intermediate medium 5.

Figure 11:
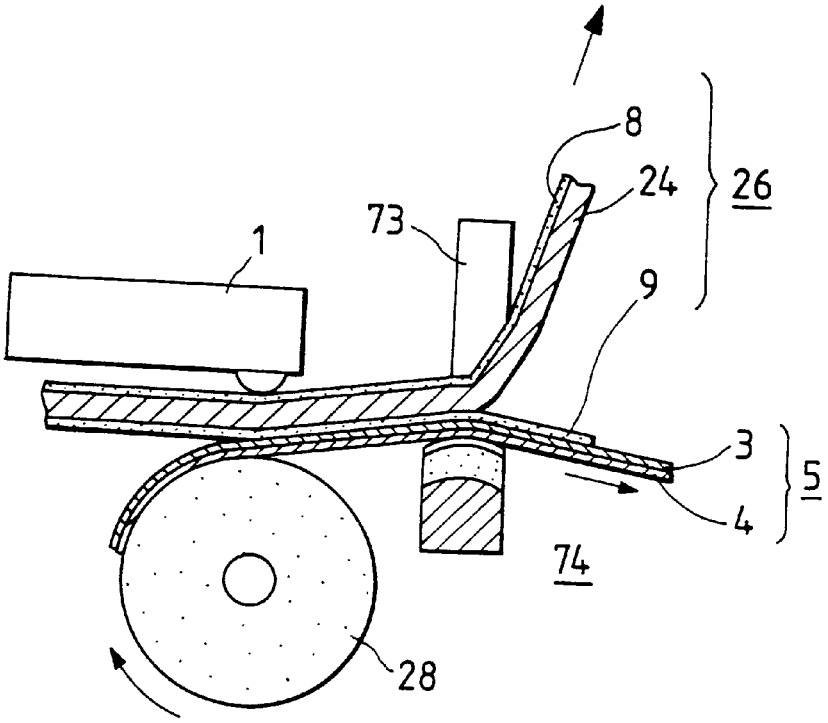
FIG. 11 is a diagram of a portion of the thermal transfer printing apparatus of FIG. 8 in conditions which occur during a process of forming a color developing layer.

FIG. 11 shows an example of conditions of a portion of the thermal transfer printing apparatus which occur during a process of forming a color developing layer.

With reference to FIG. 11, during the color developing layer forming process, the intermediate medium 5 and the color developing layer transfer sheet 26 are sandwiched between the first releasing blade 73 and the first belt support member 74. The intermediate medium 5 is curved along the curved configuration of the first belt support member 74. In a region downstream of the first releasing blade 73, the color developing layer transfer sheet 26 is drawn in a direction denoted by the upward arrow in FIG. 11. The color developing layer transfer sheet 26 is bent at the end corner of the first releasing blade 73. The color developing layer transfer sheet 26 moves along the flat inclined surface 62 (see FIG. 9) of the first releasing blade 73 while separating from the intermediate medium 5. The color developing layer transfer sheet 26 is bent by the first releasing blade 73 at an adequately large angle with respect to the intermediate medium 5. Therefore, a color developing layer 9 is easily transferred from the color developing layer transfer sheet 26 onto the intermediate medium 5. In a region downstream of the first belt support member 74, the intermediate medium 5 is drawn along a direction separating from the color developing layer transfer sheet 26. Since the intermediate medium 5 is curved along the first belt support member 74, the intermediate medium 5 stably travels without moving out of engagement with the first belt support member 74 provided that a suitable tension is applied to the intermediate medium 5.

Figure 12:
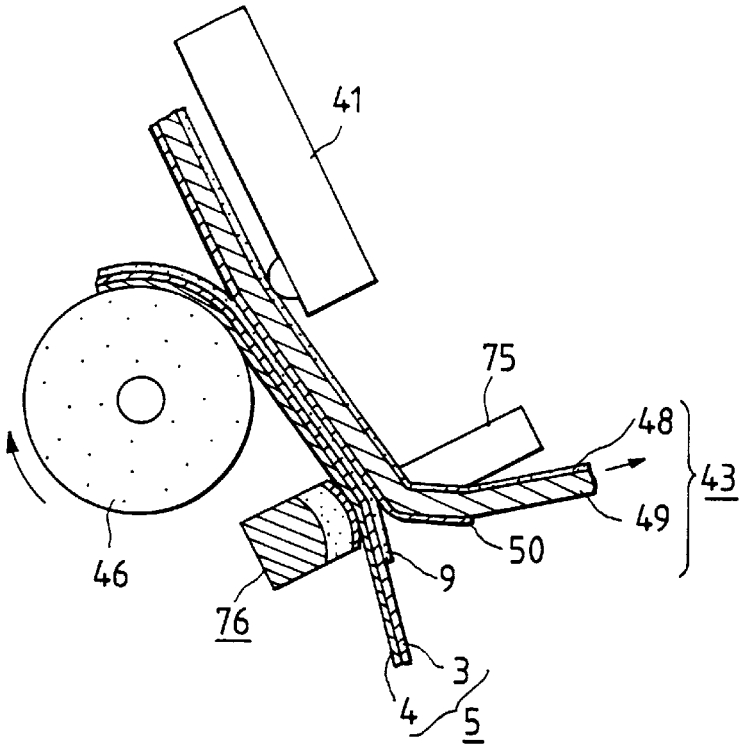
FIG. 12 is a diagram of a portion of the thermal transfer printing apparatus of FIG. 8 in conditions which occur during a process of forming a recorded picture.

FIG. 12 shows an example of conditions of a portion of the thermal transfer printing apparatus which occur during a process of forming a recorded picture (a recorded image). The recorded-picture forming process follows the previously-mentioned color developing layer forming process.

With reference to FIG. 12, during the recorded-picture forming process, the intermediate medium 5 and the dye layer transfer sheet 43 are sandwiched between the second releasing blade 75 and the second belt support member 76 in a region immediately preceding a releasing point. The intermediate medium 5 is curved along the curved configuration of the second belt support member 76. In a region downstream of the second releasing blade 75, the dye layer transfer sheet 43 is drawn in a direction denoted by the rightward arrow in FIG. 12. The dye layer transfer sheet 43 is bent at the end corner of the second releasing blade 75. The dye layer transfer sheet 43 moves along the flat inclined surface 62 (see FIG. 9) of the second releasing blade 75 while separating from the. intermediate medium 5. The dye layer transfer sheet 43 is bent by the second releasing blade 75 at an adequately large angle with respect to the intermediate medium 5 so that the boundary (the interface) between the color developing layer 9 on the intermediate medium 5 and a dye layer 50 of the dye layer transfer sheet 43 undergoes a great stress. Therefore, the dye layer 50 easily separates from the color developing layer 9. In a region downstream of the second belt support member 76, the intermediate medium 5 is drawn along a direction separating from the dye layer transfer sheet 43. Since the intermediate medium 5 is curved along the second belt support member 76, the intermediate medium 5 stably travels without moving out of engagement with the second belt support member 76 provided that a suitable tension is applied to the intermediate medium 5.

Figure 13:
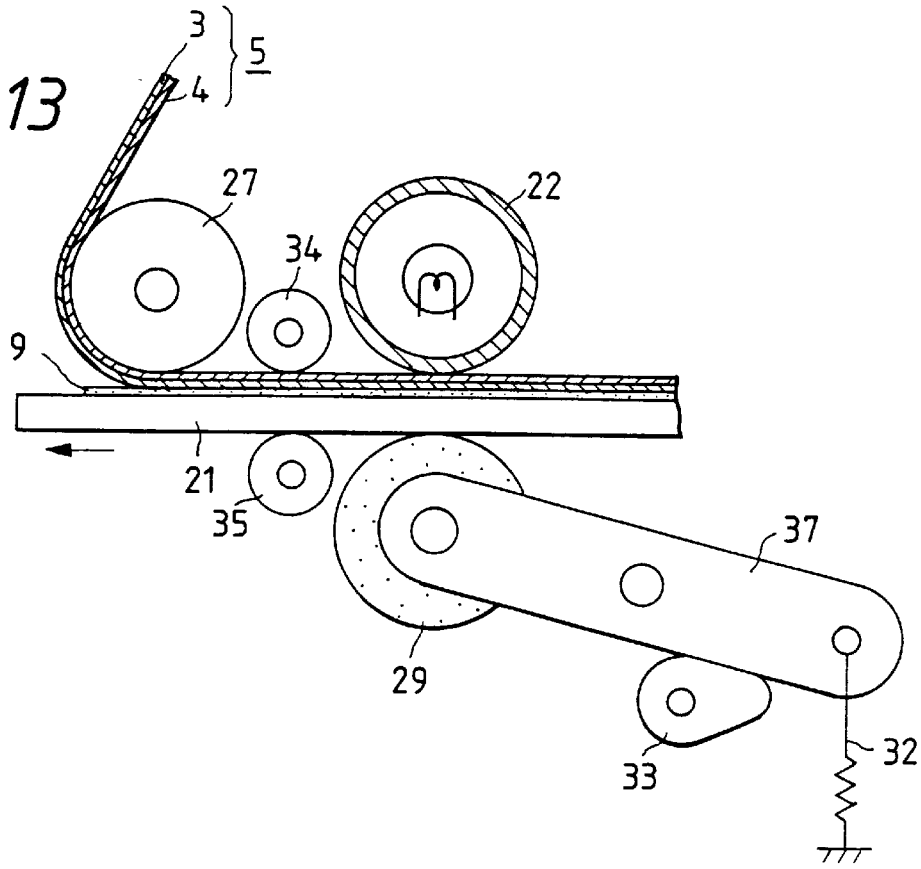
FIG. 13 is a diagram of a portion of the thermal transfer printing apparatus of FIG. 8 in conditions which occur during a transferring process.

FIG. 13 shows an example of conditions of a portion of the thermal transfer printing apparatus which occur during a transferring process. The transferring process follows the previously-mentioned recorded-picture forming process.

With reference to FIG. 13, during the transferring process, the intermediate medium 5 and an image receptor 21 which have passed the heating roller 22 are sandwiched between the belt guides 34 and 35. The belt guides 34 and 35 cooperate to suppress or prevent waves of the intermediate medium 5 which might be developed between the heating roller 22 and a first guide roller 27.

The thermal transfer printing apparatus of FIG. 8 has the following features. The end corner "D" (see FIG. 9) of the first releasing blade 73 provides a large releasing angle with respect to the separation between the intermediate medium 5 and the color developing layer transfer sheet 26. In addition, the end corner "D" (see FIG. 9) of the second releasing blade 75 provides a large releasing angle with respect to the separation between the intermediate medium 5 and the dye layer transfer sheet 43.

The bend of the color developing layer transfer sheet 26 at the end corner "D" of the first releasing blade 73 prevents insufficiency of hardness and unwanted displacement of the color developing layer transfer sheet 26. Also, the bend of the dye layer transfer sheet 43 at the end corner "D" of the second releasing blade 75 prevents insufficiency of hardness and unwanted displacement of the dye layer transfer sheet 43.

The color developing layer transfer sheet 26 moves along the flat inclined surface 62 (see FIG. 9) of the first releasing blade 73 while separating from the intermediate medium 5. The design related to this function holds the releasing angle at the angle "α" (see FIG. 9) even in the case where the diameter of a take-up roller 12 varies as time goes by. The dye layer transfer sheet 43 moves along the flat inclined surface 62 (see FIG. 9) of the second releasing blade 75 while separating from the intermediate medium 5. The design related to this function holds the releasing angle at the angle "α" (see FIG. 9) even in the case where the diameter of a take-up roller 45 varies as time goes by.

As previously described, the first and second belt support members 74 and 76 are connected and fixed to the apparatus body. It is preferable that the first and second belt support members 74 and 76 are small in size, and that the outwardly-projecting curved surfaces "E" (see FIG. 10) of the first and second belt support members 74 and 76 have small areas. The first belt support member 74 is preferably designed so that the course of the intermediate medium 5 separates from the path of the color developing layer transfer sheet 26 at a large angle. In this case, the separation between the intermediate medium 5 and the color developing layer transfer sheet 26 is stably executed. The second belt support member 76 is preferably designed so that the course of the intermediate medium 5 separates from the path of the dye layer transfer sheet 43 at a large angle. In this case, the separation between the intermediate medium 5 and the dye layer transfer sheet 43 is stably executed.

As previously described, the resilient layer 71 is provided between the base 70 and the slipping layer 72 in each of the first and second belt support members 74 and 76. The resilient layer 71 of the first belt support member 74 absorbs a variation in the force of contact between the first belt support member 74 and the intermediate medium 5 which might be caused by unevenness and deformation of a surface layer 3 and an endless belt 4 of the intermediate medium 5. Accordingly, the separation between the intermediate medium 5 and the color developing layer transfer sheet 26 is stably executed. The resilient layer 71 of the second belt support member 76 absorbs a variation in the force of contact between the second belt support member 76 and the intermediate medium 5 which might be caused by unevenness and deformation of the surface layer 3 and the endless belt 4 of the intermediate medium 5. Accordingly, the separation between the intermediate medium 5 and the dye layer transfer sheet 43 is stably executed.

The intermediate medium 5 is sandwiched between the belt guides 34 and 35 in a region between the heating roller 22 and the first guide roller 27. As previously described, the belt guides 34 and 35 cooperate to suppress or prevent waves of the intermediate medium 5 which might be developed between the heating roller 22 and the first guide roller 27. The suppression or prevention of the waves enables reliable formation of a picture on the image receptor 21.

It is preferable that the belt guides 34 and 35 are located at positions where the temperature of the color developing layer 9 is high. Specifically, it is preferable that the distance between the belt guide 34 (or the belt guide 35) and the heating roller 22 is equal to or smaller than a half of the distance between the heating roller 22 and the first guide roller 27. The material of the intermediate medium 5, the thickness of the intermediate medium 5, the heating temperature related to the heating roller 22, the material of the image receptor 21, the tension applied to the intermediate medium 5, and other conditions are preferably chosen so that the intermediate medium 5 can be prevented from waving in a region between the heating roller 22 and the belt guide 34 (or the belt guide 35). A preferred example of such conditions is given below.

A polyimide film having a thickness of 50 $\mu$m is used as the endless belt 4 of the intermediate medium 5. The surface layer 3 of the intermediate medium 5 is made of fluorine rubber ("Bitone B" produced by du Pont-Showa Denko Co., Ltd). The surface layer 3 of the intermediate medium 5 has a thickness of 30 $\mu$m. The color developing layer 9 is made of polyvinyl acetal resin ("KS-0" produced by Sekisui Chemical Co., Ltd.). An aluminum tube held at a temperature of 150° C. is used as the heating roller 22. The distance between the heating roller 22 and the first guide roller 27 is equal to 40 mm. The speed of feed (movement) of the intermediate medium 5 is equal to 10 mm/sec. A Japanese government postcard is used as the image receptor 21. The distance between the heating roller 22 and the belt guide 34 (or the belt guide 35) is equal to 20 mm or less. Under these conditions, a good picture is formed on the image receptor 21.

Another pair or other pairs of belt guides may be provided. The level of the pressurizing force exerted between the belt guides 34 and 35 is preferably chosen so that the pressurizing force can be prevented from adversely interfering with the surface of the color developing layer 9 on the intermediate medium 5. According to a first arrangement, the belt guides 34 and 35 continuously hold the intermediate medium 5 therebetween. According to a second arrangement including a suitable drive mechanism which is linked with a drive mechanism for the opposed roller 29 and which offers reciprocating motion of the belt guides 34 and 35, the belt guides 34 and 35 intermittently hold the intermediate medium 5 therebetween in synchronism with the contact of the opposed roller 29 with the intermediate medium 5 (the image receptor 21). In this case, only during the transfer of the color developing layer 9 from the intermediate medium 5 onto the image receptor 21, the belt guides 34 and 35 hold the intermediate medium 5 therebetween.

Third Embodiment

Figure 14:
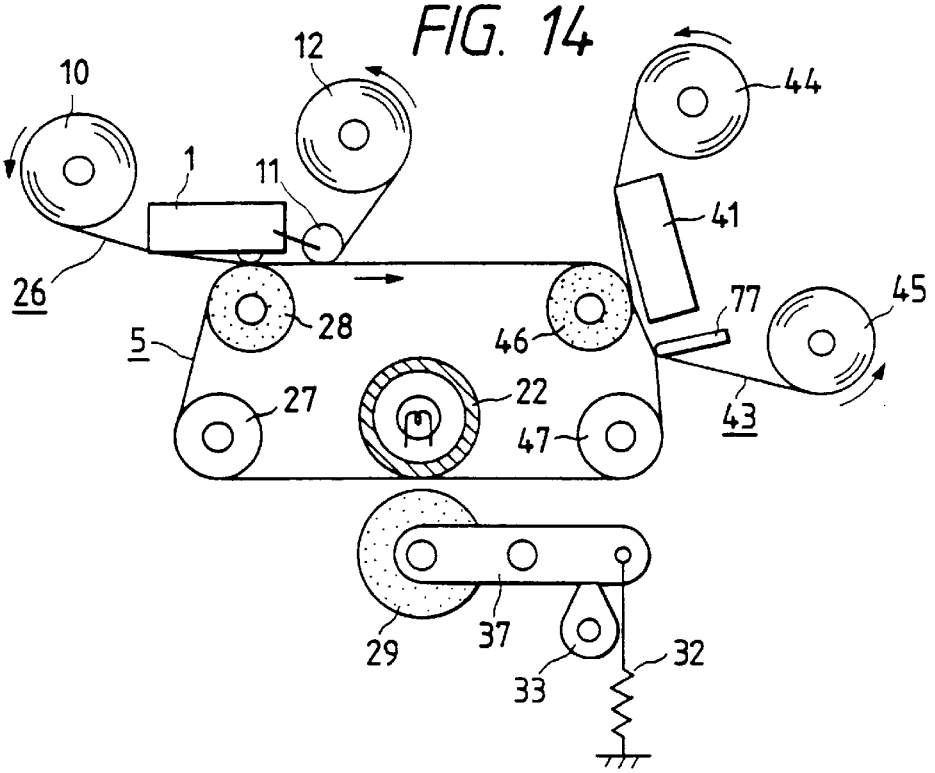
FIG. 14 is a diagram of a thermal transfer printing apparatus according to a third embodiment of this invention.

FIG. 14 shows a thermal transfer printing apparatus according to a third embodiment of this invention. The thermal transfer printing apparatus of FIG. 14 is similar to the thermal transfer printing apparatus of FIG. 1 except for design changes indicated hereinafter.

The thermal transfer printing apparatus of FIG. 14 includes a releasing blade 77 which forms a releasing or separating means located in a region between a second thermal head 41 and a second guide roller 47. During a picture recording process, a second urging device (not shown) acts on the releasing blade 77 together with the second thermal head 41 and holds the releasing blade 77 at a position separate from an intermediate medium 5. The releasing blade 77 may be mechanically connected to and supported by the second thermal head 41.

Figure 15:
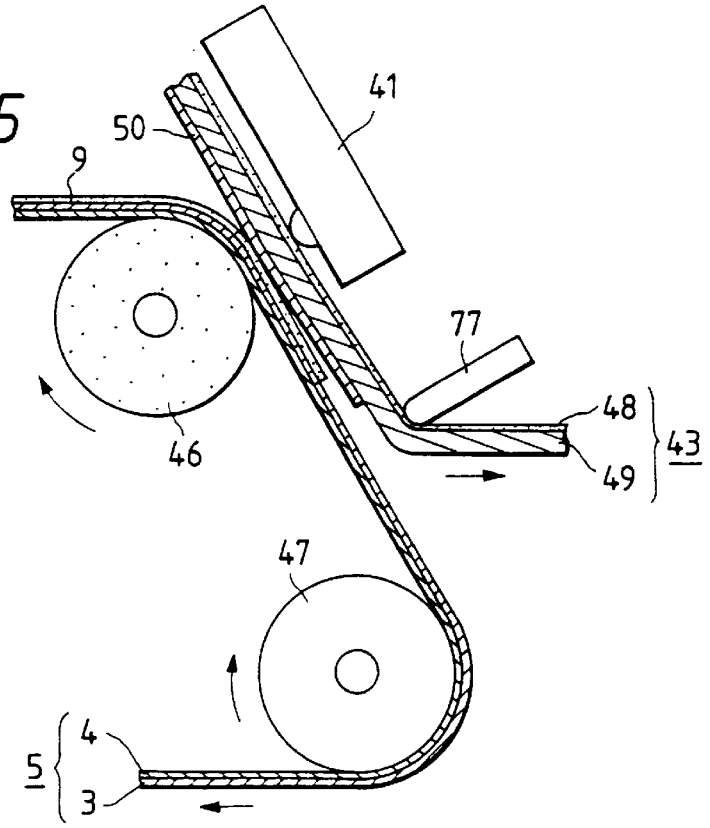
FIG. 15 is a diagram of a portion of the thermal transfer printing apparatus of FIG. 14 in conditions which occur during a process of forming a recorded picture.
Figure 16:
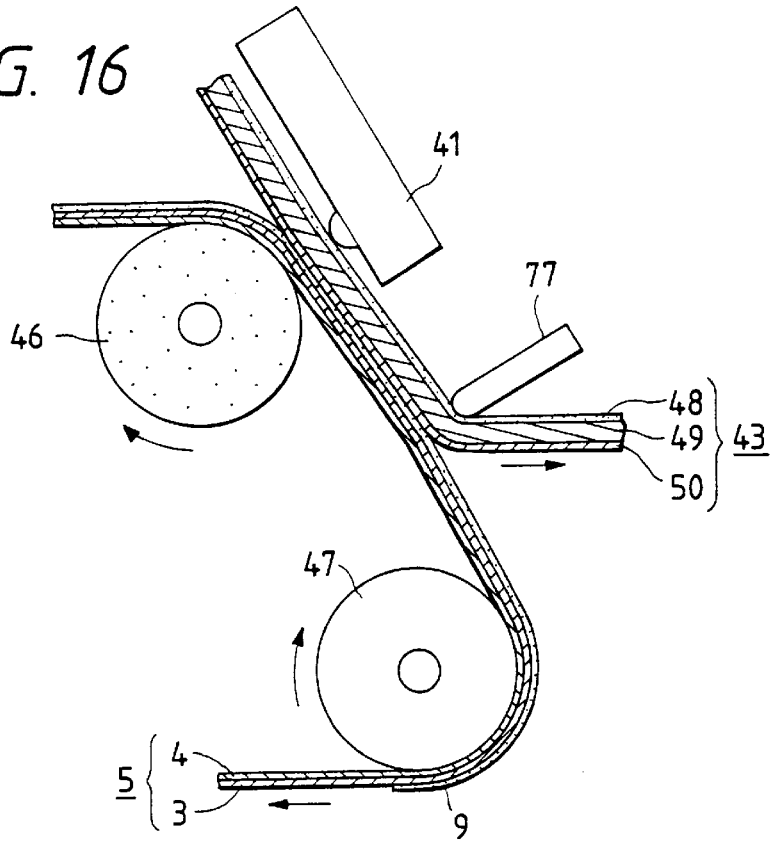
FIG. 16 is a diagram of the portion of the thermal transfer printing apparatus of FIG. 14 in conditions which occur during the process of forming the recorded picture.

FIG. 15 and FIG. 16 show examples of conditions of a portion of the thermal transfer printing apparatus which occur during a process of forming a recorded picture (a recorded image). The recorded-picture forming process follows a color developing layer forming process.

With reference to FIG. 15, during the recorded-picture forming process, a dye layer transfer sheet 43 is sandwiched between the intermediate medium 5 and the second thermal head 41 so that a color developing layer 9 on the intermediate medium 5 and a yellow dye layer 50 on the dye layer transfer sheet 43 will contact with each other. At this stage, an adhesive force is not yet present between the color developing layer 9 and the yellow dye layer 50. Thus, the intermediate medium 5 extends along a tangential line common to a second platen roller 46 and the second guide roller 47. On the other hand, the dye layer transfer sheet 43 extends along a line connecting active edges of the second thermal head 41 and the releasing blade 77. Accordingly, in this case, the intermediate medium 5 and the dye layer transfer sheet 43 start to separate from each other at a position immediately following (immediately downstream of) the point of contact between the second thermal head 41 and the dye layer transfer sheet 43.

During the recorded-picture forming process, the second thermal head 41 is energized or activated in response to a picture signal (an image signal) while the second paten roller 46 is rotated by a drive mechanism (not shown) in a direction denoted by the arrow in FIG. 15. Accordingly, the second thermal head 41 selectively heats the yellow dye layer 50 and the color developing layer 9. Heated portions of the yellow dye layer 50 and the color developing layer 9 have adhesive forces. The adhesive forces cause the intermediate medium 5 to be pulled by the dye layer transfer sheet 43 as shown in FIG. 16, and hence the intermediate medium 5 has an outwardly-projecting configuration at and around a releasing point provided by an end of the releasing blade 77. On the other hand, the dye layer transfer sheet 43 is bent by the end of the releasing blade 77 at a large angle from the direction of movement of the intermediate medium 5. Therefore, at the releasing point, the dye layer transfer sheet 43 and the intermediate medium 5 separate from each other while traveling along directions forming a large angle (a large releasing angle) therebetween. Since the intermediate medium 5 is pulled outward by the dye layer transfer sheet 43, there occurs a force of separating the color developing layer 9 and the yellow dye layer 50 from each other at the releasing point. This force enables easy separation between the intermediate medium 5 and the dye layer transfer sheet 43.

The thermal transfer printing apparatus of FIG. 14 has the following features. The releasing blade 77 is provided in a region downstream of the second thermal head 41. The releasing blade 77 is located between the second platen roller 46 and the second guide roller 47. The releasing blade 77 extends outward of the intermediate medium 5. The releasing blade 77 separates from the path of the intermediate medium 5 so that the releasing blade 77 is prevented from interfering with movement of the intermediate medium 5. The releasing blade 77 supports the dye layer transfer sheet 43. The releasing blade 77 enables stable separation of the dye layer transfer sheet 43 from the intermediate medium 5 even in the case where the temperature of the intermediate medium 5 is relatively high.

The thermal transfer printing apparatus of FIG. 14 has a less number of parts since a belt support member associated with the releasing blade 77 is omitted.

It is preferable to set the position of the releasing blade 77 in consideration of the material of the intermediate medium 5, the thickness of the intermediate medium 5, the strength of a tension applied to the intermediate medium 5, and the level of the adhesive force between the color developing layer 9 and the yellow dye layer 50.

Fourth Embodiment

Figure 17:
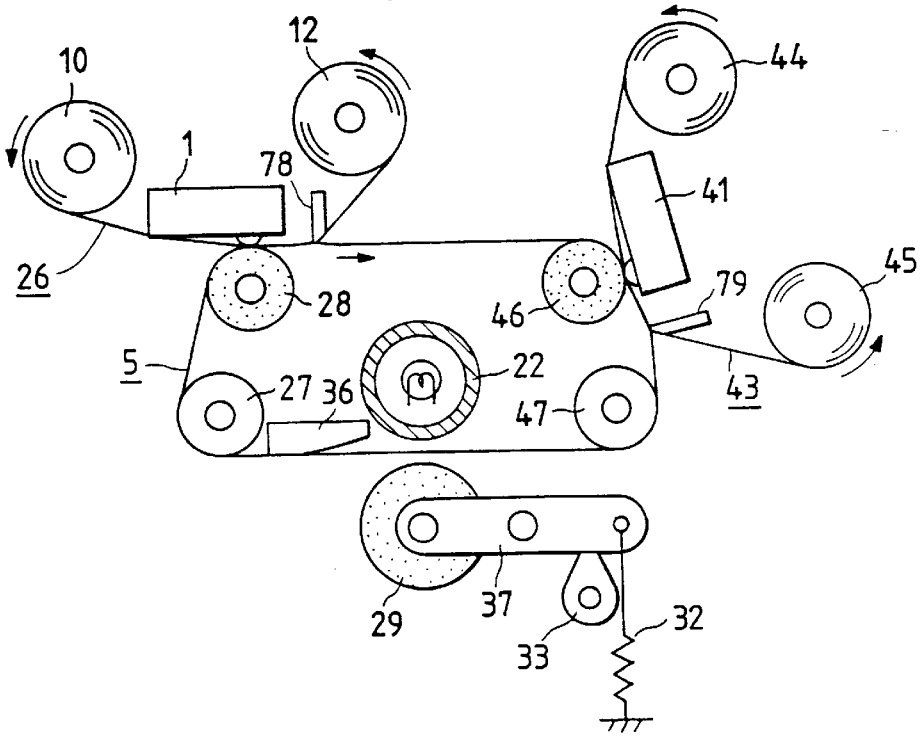
FIG. 17 is a diagram of a thermal transfer printing apparatus according to a fourth embodiment of this invention.

FIG. 17 shows a thermal transfer printing apparatus according to a fourth embodiment of this invention. The thermal transfer printing apparatus of FIG. 17 is similar to the thermal transfer printing apparatus of FIG. 1 except for design changes indicated hereinafter.

The thermal transfer printing apparatus of FIG. 17 includes a first releasing blade 78 and a second releasing blade 79. The first releasing blade 78 forms a releasing or separating means located in a region between a first thermal head 1 and a second thermal head 41. The second releasing blade 79 forms a releasing or separating means located in a region between the second thermal head and a second guide roller 47.

The first and second releasing blades 78 and 79 have a shape similar to the shape of the releasing blades 73 and 75 in FIGS. 8 and 9. Thus, as shown in FIG. 9, each of the first and second releasing blades 78 and 79 has an end corner "D" and a flat inclined surface 62.

During a color developing layer forming process, a first urging device (not shown) acts on the first releasing blade 78 together with the first thermal head 1 and holds the first releasing blade 78 at a position separate from an intermediate medium 5. The first releasing blade 78 may be mechanically connected to and supported by the first thermal head 1.

During a picture recording process, a second urging device (not shown) acts on the second releasing blade 79 together with the second thermal head 41 and holds the second releasing blade 79 at a position separate from the intermediate medium 5. The releasing blade 79 may be mechanically connected to and supported by the second thermal head 41.

The thermal transfer printing apparatus of FIG. 17 includes a belt guide 36 located in a region between a heating roller 22 and a first guide roller 27. The belt guide 36 extends inward of the intermediate medium 5. The belt guide 36 has a plate-like shape with a given curvature. The belt guide 36 supports the whole of the width of the intermediate medium 5.

The heating roller 22 separates from the normal path of the intermediate medium 5. When an opposed roller 29 is pressed against the heating roller 22 via the intermediate medium 5, the line connecting the centers of the rollers 22 and 29 is approximately perpendicular to the direction of movement of the intermediate medium 5 in a region following the rollers 22 and 29.

Figure 18:
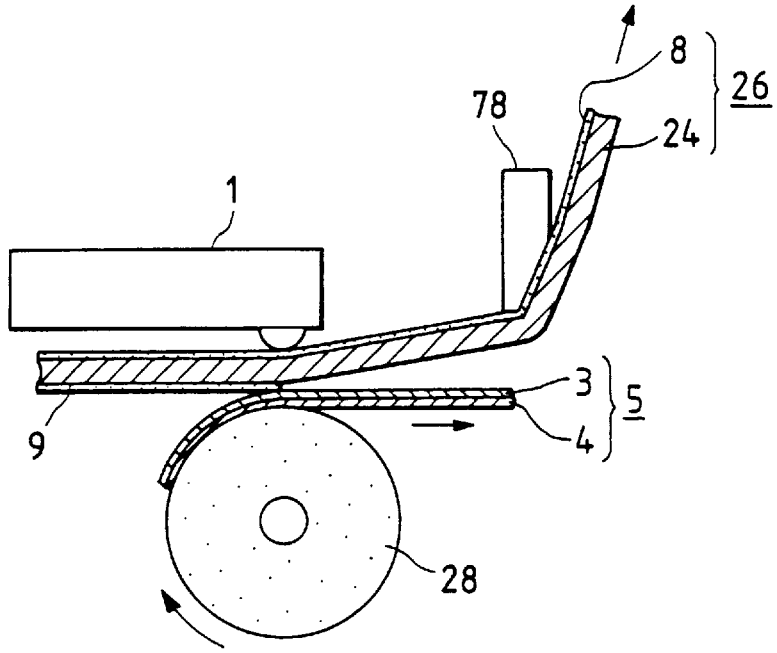
FIG. 18 is a diagram of a portion of the thermal transfer printing apparatus of FIG. 17 in conditions which occur during a process of forming a color developing layer.
Figure 19:
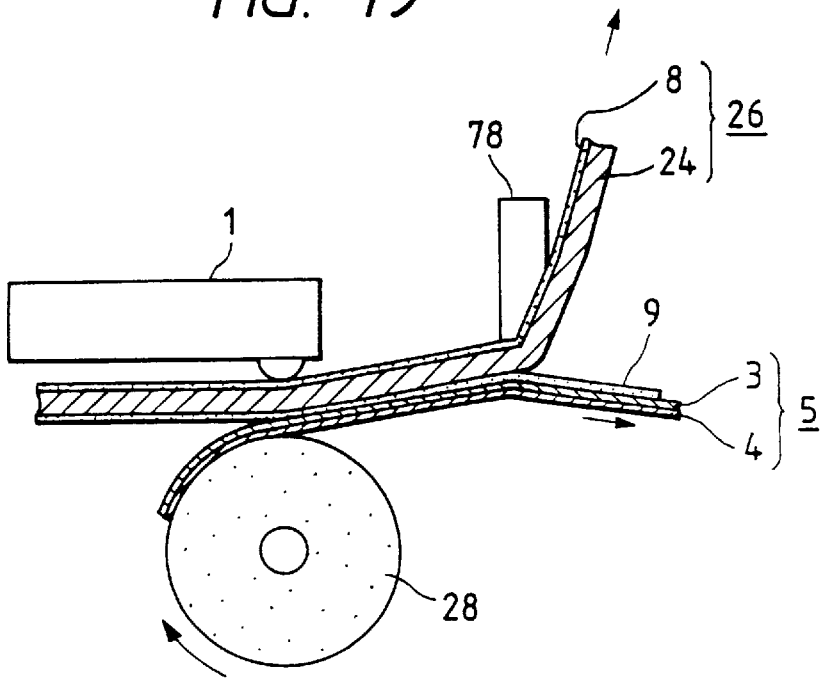
FIG. 19 is a diagram of the portion of the thermal transfer printing apparatus of FIG. 17 in conditions which occur during the process of forming the color developing layer.

FIG. 18 and FIG. 19 show examples of conditions of a portion of the thermal transfer printing apparatus which occur during a process of forming a color developing layer.

With reference to FIG. 18, during the color developing layer forming process, a color developing layer transfer sheet 26 is sandwiched between the first thermal head 1 and the intermediate medium 5 so that a color developing layer 9 and the intermediate medium 5 will contact with each other. The first thermal head 1 is energized or activated while a first paten roller 28 is rotated by a drive mechanism (not shown) in a direction denoted by the arrow in FIG. 18. Accordingly, the first thermal head 1 heats the whole of the color developing layer 9 and thereby softens the whole of the color developing layer 9 as the color developing layer transfer sheet 26 advances. To implement reliable heating of the whole of the color developing layer 9, it is preferable that the first thermal head 1 starts to be energized before a head of the color developing layer 9 reaches an active portion of the first thermal head 1. Since the base film 24 in the color developing layer transfer sheet 26 has a high glass-transition temperature "Tg" than that of the color developing layer 9, the color developing layer 9 does not have an adhesive force although being heated by the first thermal head 1. Therefore, during an initial stage of the color developing layer forming process, the intermediate medium 5 continues to travel along a tangential line common to the first platen roller 28 and a second platen roller 46 as shown in FIG. 18. The color developing layer transfer sheet 26 extends along a line connecting active edges of the first thermal head 1 and the first releasing blade 78. Accordingly, in this case, the intermediate medium 5 and the color developing layer transfer sheet 26 start to separate from each other at a position immediately following (immediately downstream of the point of contact between the first thermal head 1 and the color developing layer transfer sheet 26.

As a result of being heated by the first thermal head 1, the whole of the color developing layer 9 has an adhesive force with respect to the intermediate medium 5. The adhesive force causes the intermediate medium 5 to be pulled by the color developing layer transfer sheet 26 as shown in FIG. 19, and hence the intermediate medium 5 has an outwardly-projecting configuration at and around a releasing point defined by an end of the first releasing blade 78. On the other hand, the color developing layer transfer sheet 26 is bent by the end of the first releasing blade 78 at a large angle from the direction of movement of the intermediate medium 5. Therefore, at the releasing point, the color developing layer transfer sheet 26 and the intermediate medium 5 separate from each other while traveling along directions forming a large angle (a large releasing angle) therebetween. This large releasing angle enables easy separation between the color developing layer transfer sheet 26 and the intermediate medium 5, and also easy transfer of the color developing layer 9 from the color developing layer transfer sheet 26 onto the intermediate medium 5. Since the intermediate medium 5 is pulled outward by the color developing layer transfer sheet 26, there occurs a force of separating the color developing layer 9 from the color developing layer transfer sheet 26 at the releasing point. This force enables easy separation of the color developing layer 9 from the color developing layer transfer sheet 26.

A recorded-picture forming process follows the color developing layer forming process. During the recorded-picture forming process, the thermal transfer printing apparatus of FIG. 17 operates similarly to the thermal transfer printing apparatus of FIG. 14. During the recorded-picture forming process, the second releasing blade 79 enables stable separation between the intermediate medium 5 and a dye layer transfer sheet 43.

Figure 20:
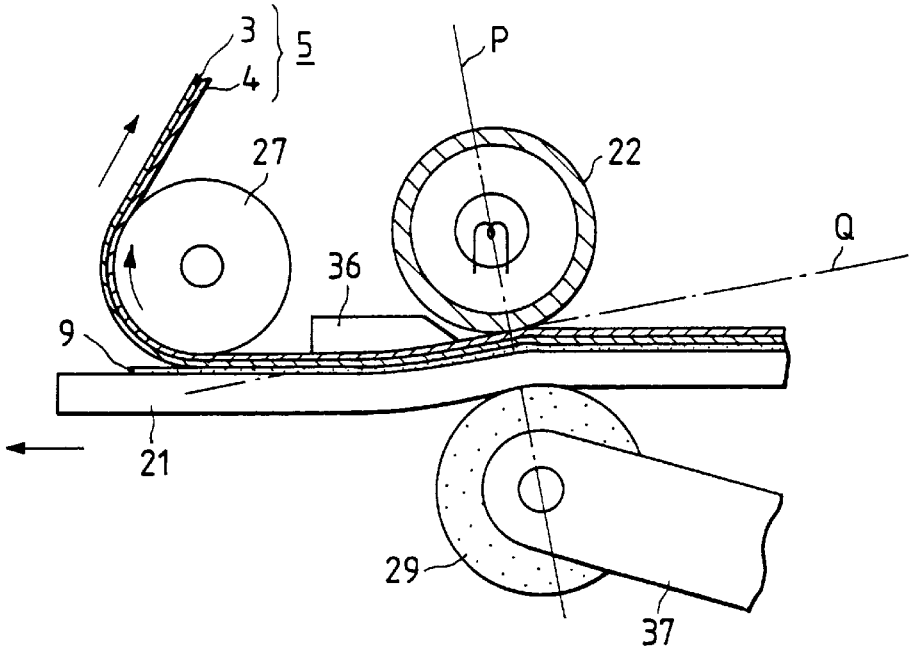
FIG. 20 is a diagram of a portion of the thermal transfer printing apparatus of FIG. 17 in conditions which occur during a transferring process.

FIG. 20 shows an example of conditions of a portion of the thermal transfer printing apparatus which occur during a transferring process. The transferring process follows the recorded-picture forming process.

With reference to FIG. 20, during the transferring process, the intermediate medium 5 and an image receptor 21 are passed through a region between the heating roller 22 and the opposed roller 29 while the color developing layer 9 on the intermediate medium 5 is held in contact with the image receptor 21. It should be noted that the color developing layer 9 is formed with a full color picture during the recorded-picture forming process. The opposed roller 29 displaces the intermediate medium 5 toward the heating roller 22 and presses the intermediate medium 5 against the heating roller 22. The intermediate medium 5 is also brought into contact with the belt guide 36. A suitable tension is applied to the intermediate medium 5 so that the intermediate medium 5 is properly pressed against the belt guide 36. The belt guide 36 suppresses or prevents waves of the intermediate medium 5 which might be developed between the heating roller 22 and the first guide roller 27.

During the transferring process, as shown in FIG. 20, the line "P" connecting the centers of the heating roller 22 and the opposed roller 29 is approximately perpendicular to the direction "Q" of travel of the intermediate medium 5 in a region immediately following the heating roller 22. This design enables the travel of the image receptor 21 to be linear in a region immediately following the heating roller 22 so that the image receptor 21 is prevented from warping after the transfer of the full color picture thereto.

The thermal transfer printing apparatus of FIG. 17 has the following features. The first releasing blade 78 is located between the first thermal head 1 and the second thermal head 41. The first releasing blade 78 supports the color developing layer transfer sheet 26 at a position outward of and separate from the intermediate medium 5. On the other hand, the second releasing blade 79 is located between the second thermal head 41 and the second guide roller 47. The second releasing blade 79 supports the dye layer transfer sheet 43 at a position outward of and separate from the intermediate medium 5. According to the presence of the first and second releasing blades 78 and 79, the thermal transfer printing apparatus of FIG. 17 has features similar to those of the thermal transfer printing apparatuses of FIGS. 8 and 14 regarding the color developing layer forming process and the recorded-picture forming process.

The belt guide 36 is provided in a region between the heating roller 22 and the first guide roller 27. The belt guide 36 suppresses or prevents waves of the intermediate medium 5 which might be developed between the heating roller 22 and the first guide roller 27. The suppression or prevention of the waves enables reliable formation of a picture (an image) on the image receptor 21.

The heating roller 22 separates from the normal path of the intermediate medium 5. Only during the transferring process for which the color developing layer 9 is transferred and fixed to the image receptor 21, the intermediate medium 5 is brought into contact with the heating roller 22. This design prevents an unwanted rise in temperature of the intermediate medium 5 and unwanted re-coloring of a recorded picture during processes other than the transferring process.

Since the belt guide 36 extends inward of the intermediate medium 5, the belt guide 36 remains out of contact with the color developing layer 9 on the intermediate medium 5. Therefore, the belt guide 36 is prevented from adversely affecting the color developing layer 9.

In the case where the opposed roller 29 presses the intermediate medium 5 against the heating roller 22, the line "P" connecting the centers of the heating roller 22 and the opposed roller 29 is approximately perpendicular to the direction "Q" of travel of the intermediate medium 5 in a region immediately following the heating roller 22 as shown in FIG. 20. This design prevents the image receptor 21 from warping after the transfer of the full color picture thereto.

Figure 21:
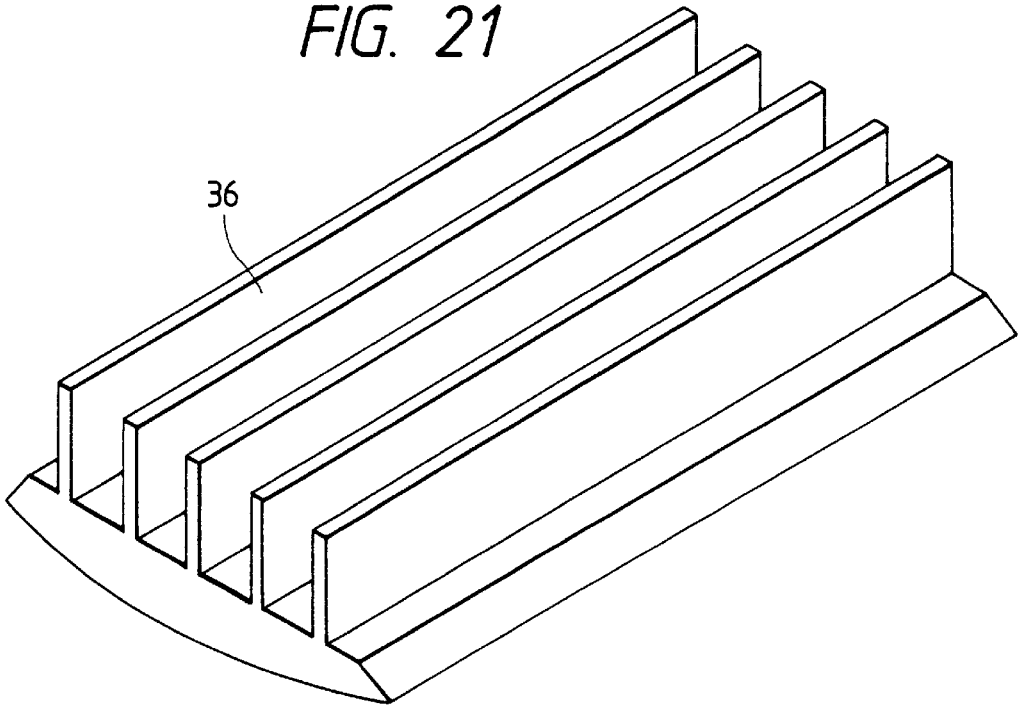
FIG. 21 is a perspective view of a modification of a belt guide in the apparatus of FIG. 17.

The belt guide 36 is preferably made of aluminum. In addition, it is preferable that the belt guide 36 has radiating fins as shown in FIG. 21. In this case, the belt guide 36 effectively cools the color developing layer 9 after the color developing layer 9 passes the heating roller 22. In addition, the belt guide 36 can prevent an unwanted rise in temperature of the intermediate medium 5. It is good to provide a cooling fan for driving air through the fins of the belt guide 36.

Fifth Embodiment

Figure 22:
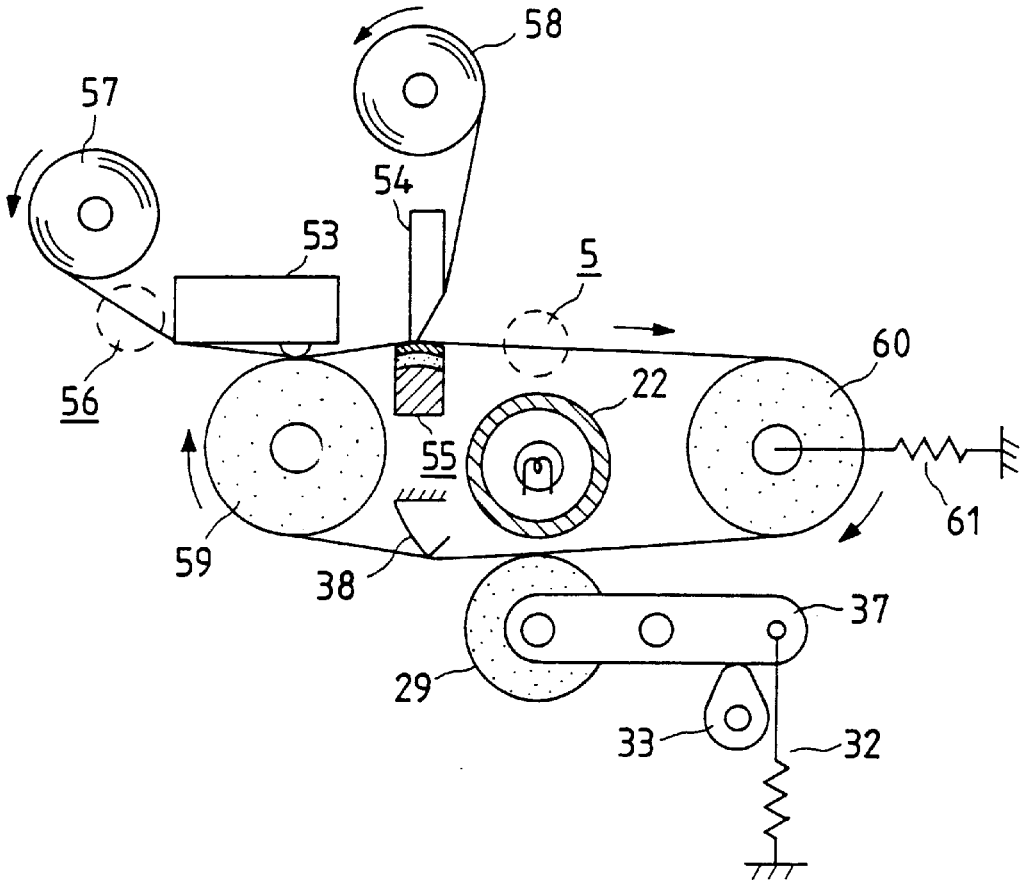
FIG. 22 is a diagram of a thermal transfer printing apparatus according to a fifth embodiment of this invention.

With reference to FIG. 22, a thermal transfer printing apparatus includes a transfer sheet 56 and an intermediate medium (an intermediate recording medium) 5. The transfer sheet 56 serves as both a color developing layer transfer sheet and a dye layer transfer sheet. The intermediate medium 5 is similar to that of FIGS. 1 and 4.

Figure 23:
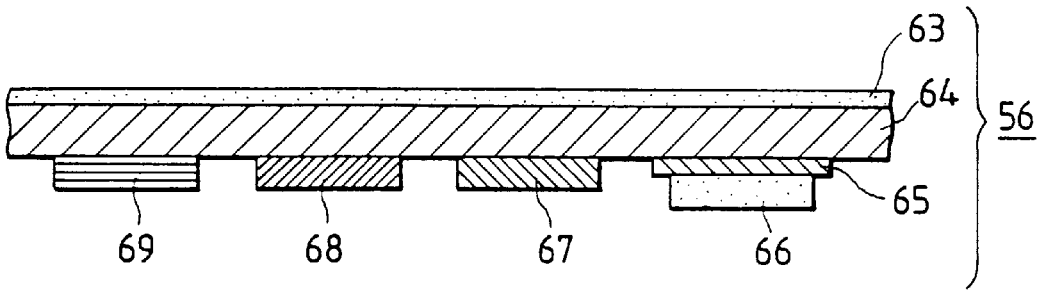
FIG. 23 is a sectional view of a transfer sheet in the apparatus of FIG. 22.

As shown in FIG. 23, the transfer sheet 56 has a base film (a layer substrate) 64, a heat-resisting and slipping layer 63, a release layer 65, a color developing layer 66, a yellow dye layer 67, a magenta dye layer 68, and a cyan dye layer 69. The base film 64 is made of, for example, polyester. The heat-resisting and slipping layer 63 is provided on one side of the base film 64. The release layer 65, the yellow dye layer 67, the magenta dye layer 68, and the cyan dye layer 69 are provided on the other side of the base film 64. The color developing layer 66 is provided on the release layer 65. The release layer 65, the yellow dye layer 67, the magenta dye layer 68, and the cyan dye layer 69 are sequentially arranged in that order.

With reference back to FIG. 22, the thermal transfer printing apparatus includes a thermal head 53 and a platen roller 59. The thermal head 53 serves as both a means for forming a color developing layer and a means for forming a recorded picture (a means for recording an image). During the formation of a color developing layer and also the recording of a picture, a first urging device (not shown) presses the thermal head 53 against the platen roller 59 via the transfer sheet 56 and the intermediate medium 5.

A releasing blade 54 and a belt support member 55 are located in a region following the thermal head 53 and the platen roller 59. The releasing blade 54 extends outward of the loop defined by the intermediate medium 5. The belt support member 55 extends inward of the loop defined by the intermediate medium 5. During the formation of a color developing layer and also the recording of a picture, a second urging device (not shown) presses the releasing blade 54 against the belt support member 55 via the transfer sheet 56 and the intermediate medium 5. The belt support member 55 is fixed to a body (not shown) of the apparatus. The releasing blade 54 is similar to that of FIGS. 8 and 9. The belt support member 55 is similar to that of FIGS. 8 and 10.

The transfer sheet 56 extends between a supply roller 57 and a take-up roller 58. The supply roller 57 is located in a region upstream of the thermal head 53 as viewed in the direction of travel of the transfer sheet 56. The take-up roller 58 is located in a region downstream of the releasing blade 54. The take-up roller 58 is rotated by a drive mechanism (not shown), moving the transfer sheet 56 from the supply roller 57 and winding the transfer sheet 56.

An idler roller 60 supports the intermediate medium 5 in conjunction with the platen roller 59. A tension spring 61 urges the idler roller 60, thereby applying a given tension to the intermediate medium 5.

A heating roller 22 is located in a region from the idler roller 60 to the platen roller 59. The heating roller 22 extends inward of the loop defined by the intermediate medium 5. An opposed roller 29 with respect to the heating roller 22 is located outside the loop defined by the intermediate medium 5. Thus, the intermediate medium 5 extends between the heating roller 22 and the opposed roller 29. The opposed roller 29 is supported on a first end of a lever 37. The lever 37 is rotatable about its center. A spring 32 is provided between a second end of the lever 37 and a fixed support. A rotatable cam 33 engages a portion of the lever 37 near its second end. The lever 37, the spring 32, and the cam 33 compose a mechanism for pressing the opposed roller 29 toward the heating roller 22. Specifically, the force of the spring 32 acts on the opposed roller 29 via the lever 37, pressing the opposed roller 29 against the heating roller 22 via the intermediate medium 5. The cam 33 can be driven by a suitable device (not shown). Rotation of the cam 33 turns the lever 37, moving the opposed roller 29 toward and away from the heating roller 22. The heating roller 22, the opposed roller 29, the lever 37, the spring 32, and the cam 33 compose a transferring means.

A belt guide 38 is located in a region between the heating roller 22 and the platen roller 59. The belt guide 38 extends inward of the loop defined by the intermediate medium 5. The belt guide 38 urges the intermediate medium 5 outward so that the intermediate medium 5 is normally separated from the heating roller 22. The belt guide 38 is supported by the apparatus body. The belt guide 38 includes, for example, a leaf spring.

Figure 24:
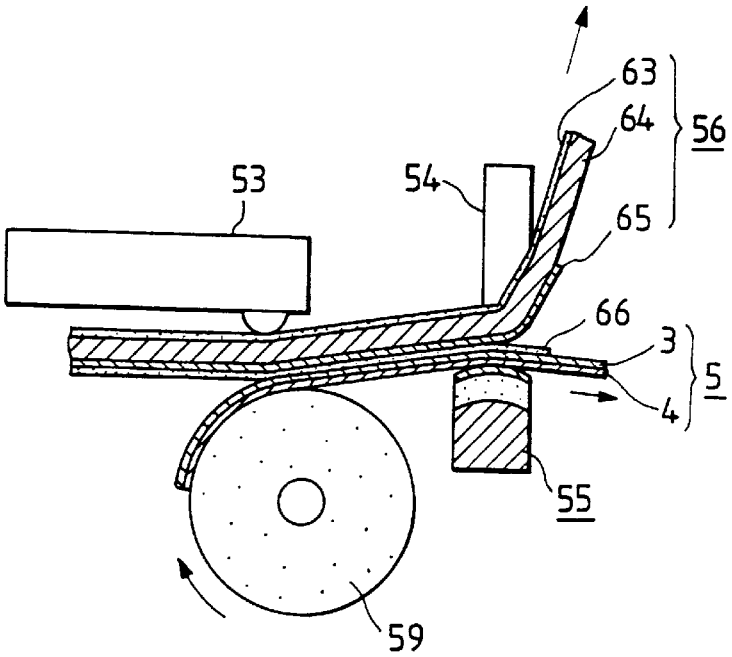
FIG. 24 is a diagram of a portion of the thermal transfer printing apparatus of FIG. 22 in conditions which occur during a process of forming a color developing layer.

The thermal transfer printing apparatus of FIG. 22 operates as follows. FIG. 24 shows an example of conditions of a portion of the thermal transfer printing apparatus which occur during a process of forming a color developing layer.

With reference to FIG. 24, during the color developing layer forming process, the transfer sheet 56 is sandwiched between the thermal head 53 and the intermediate medium 5 so that the color developing layer 66 and the intermediate medium 5 will contact with each other. The thermal head 53 is energized or activated while the paten roller 59 is rotated by a drive mechanism (not shown) in a direction denoted by the arrow in FIG. 24. Accordingly, the thermal head 53 heats the whole of the color developing layer 66 and thereby softens the whole of the color developing layer 66 as the transfer sheet 56 advances. Consequently, the whole of the color developing layer 66 has an adhesive force with respect to the intermediate medium 5. The transfer sheet 56 and the intermediate medium 5 separate from each other at a releasing point defined between the releasing blade 54 and the belt support member 55.

During the color developing layer forming process, the transfer sheet 56 and the intermediate medium 5 are sandwiched between the releasing blade 54 and the belt support member 55 in a region immediately preceding the releasing point. The intermediate medium 5 is bent along a curved surface of the belt support member 55. The transfer sheet 56 is bent at an end corner "D" (see FIG. 9) of the releasing blade 54 at a large angle from the path of the intermediate medium 5 in a region downstream of the releasing point. In a region following the releasing blade 54, the transfer sheet 56 is drawn along a direction denoted by the arrow in FIG. 24 so that the transfer sheet 56 advances along a flat inclined surface 62 (see FIG. 9) of the releasing blade 54 and separates from the intermediate medium 5. Since the color developing layer 66 is provided on the release layer 65 and the releasing blade 54 provides a large releasing angle, the color developing layer 66 is easily transferred onto the intermediate medium 5.

Figure 25:
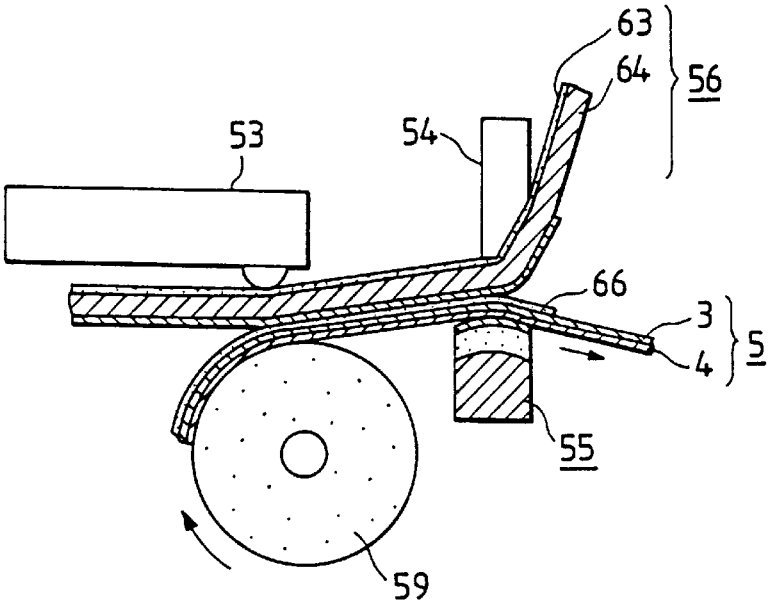
FIG. 25 is a diagram of a portion of the thermal transfer printing apparatus of FIG. 22 in conditions which occur during a process of forming a recorded picture.

FIG. 25 shows an example of conditions of a portion of the thermal transfer printing apparatus which occur during a process of forming a recorded picture (a recorded image). The recorded-picture forming process follows the previously-mentioned color developing layer forming process.

With reference to FIG. 25, during the recorded-picture forming process, the transfer sheet 56 is sandwiched between the intermediate medium 5 and the thermal head 53 so that the color developing layer 66 on the intermediate medium 5 and the yellow dye layer 67 on the transfer sheet 56 will contact with each other. The thermal head 53 is energized or activated in response to a picture signal (an image signal) while the paten roller 59 is rotated in the direction denoted by the arrow in FIG. 25. Accordingly, the thermal head 53 selectively heats the yellow dye layer 67, thereby transferring yellow dye from heated portions of the yellow dye layer 67 onto the color developing layer 66 and forming a yellow picture on the color developing layer 66. The formed yellow picture depends on the picture signal. After the yellow dye is transferred onto the color developing layer 66, the yellow dye layer 67 on the transfer sheet 56 and the color developing layer 66 on the intermediate medium 5 are separated from each other. In a region between the releasing blade 54 and the belt support member 55 which immediately precedes a releasing point, the intermediate medium 5 and the transfer sheet 56 are sandwiched between the releasing blade 54 and the belt support member 55. Then, the intermediate medium 5 and the transfer sheet 56 pass the releasing point. Specifically, as the intermediate medium 5 travels along the curved surface of the belt support member 55, the intermediate medium 5 separates from the transfer sheet 56. The releasing blade 54 causes the transfer sheet 56 to advance along a bent path separating from the intermediate medium at a large angle (a large releasing angle). This large angle results in easy separation between the yellow dye layer 67 on the transfer sheet 56 and the color developing layer 66 on the intermediate medium 5.

In this way, the yellow-related steps in the recorded-picture forming process are executed. During the recorded-picture forming process, after the yellow-related steps have been completed, magenta-related steps similar to the yellow-related steps and cyan-related steps similar to the yellow-related steps are sequentially executed. As a result, the color developing layer 66 on the intermediate medium 5 is formed with a full color recorded picture.

Figure 26:
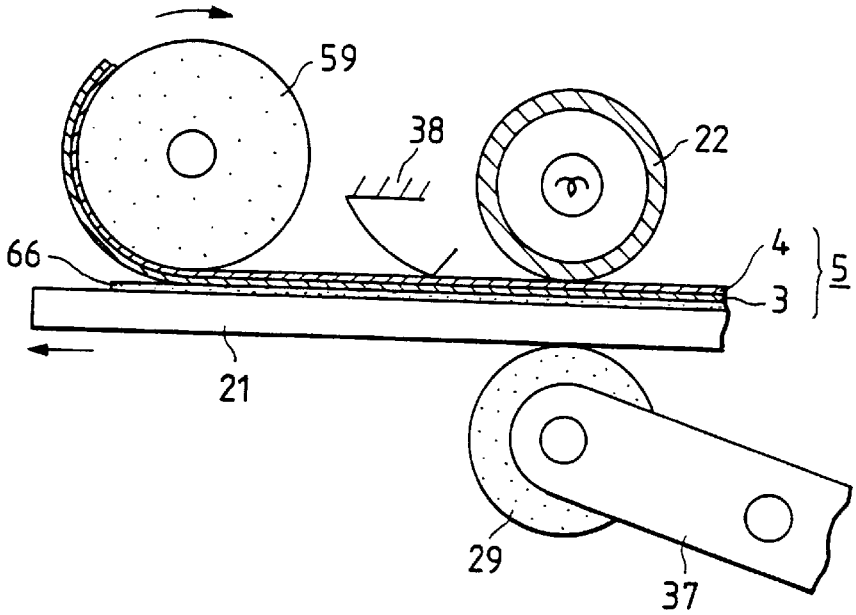
FIG. 26 is a diagram of a portion of the thermal transfer printing apparatus of FIG. 22 in conditions which occur during a transferring process.

FIG. 26 shows an example of conditions of a portion of the thermal transfer printing apparatus which occur during a transferring process. The transferring process follows the previously-mentioned recorded-picture forming process.

With reference to FIG. 26, during the transferring process, the cam 33 is rotated into a position at which the opposed roller 29 is pressed against the heating roller 22 via the intermediate medium 5. The intermediate medium 5 and an image receptor (a picture receptor) 21 are driven through a region between the opposed roller 29 and the heating roller 22 while the color developing layer 66 on the intermediate medium 5 is in contact with the image receptor 21. As previously described, the color developing layer 66 on the intermediate medium 5 has the full color recorded picture. The image receptor 21 includes a plain paper such as a PPC sheet or a postcard. After the intermediate medium 5 passes the heating roller 22, the intermediate medium 5 travels around a part of the platen roller 59 along a curved path and hence separates from the image receptor 21. During the transferring process, the full color recorded picture is transferred and fixed onto the image receptor 21. Specifically, the color developing layer 66 on the intermediate medium 5 is heated by the heating roller 22 to a temperature at which the color developing layer 66 has an adequate adhesive force with respect to the image receptor 21. Generally, this temperature is equal to or higher than the flow softening point of the bonding resin in the color developing layer 66. As the color developing layer 66 moves from the heating roller 22 to the platen roller 59, the color developing layer 66 is cooled to a temperature at which the film cohesive force on the color developing layer 66 is sufficiently stronger than the adhesive force with respect to the surface layer 3 of the intermediate medium 5. Therefore, the color developing layer 66 which has the full color recorded picture is stably transferred and fixed onto the image receptor 21 without undergoing cohesive destruction.

During the transferring process, the opposed roller 29 displaces the intermediate medium 5 from its normal path and presses the intermediate medium 5 against the heating roller 22.

As the intermediate medium 5 is displaced, the belt guide 38 is deformed so that the belt guide 38 exerts a stronger urging force on the intermediate medium 5. The belt guide 38 suppresses or prevents waves of the intermediate medium 5 which might be developed between the heating roller 22 and the platen roller 59. The tension applied to the intermediate medium 5 by the tension spring 61 (see FIG. 22) is preferably chosen to implement effective suppression of waves of the intermediate medium 5.

The thermal transfer printing apparatus of FIG. 22 has the following features. The transfer sheet 56 serves as both a color developing layer transfer sheet and a dye layer transfer sheet. The thermal head 53 serves as both the color developing layer forming means and the picture forming means (the image recording means). There is only one platen roller 59. Therefore, the thermal transfer printing apparatus of FIG. 22 has a less number of parts. This is advantageous in cost and miniaturization of the apparatus.

Since the color developing layer 66 is provided on the release layer 65. the color developing layer 66 is easily separated from the transfer sheet 56.

The belt guide 38 suppresses or prevents waves of the intermediate medium 5 which might be developed between the heating roller 22 and the platen roller 59. The belt guide 38 is of a simple structure including, for example, a leaf spring.

The belt guide 38 urges the intermediate medium 5 outward and hence enables the normal path of the intermediate medium 5 to separate from the heating roller 22. Only during the transferring process for which the color developing layer 66 is transferred and fixed onto the image receptor 21, the intermediate medium 5 is brought into contact with the heating roller 22 by the opposed roller 29. This design prevents an unwanted rise in temperature of the intermediate medium 5 and unwanted re-coloring of a recorded picture during processes other than the transferring process.

Sixth Embodiment

Figure 27:
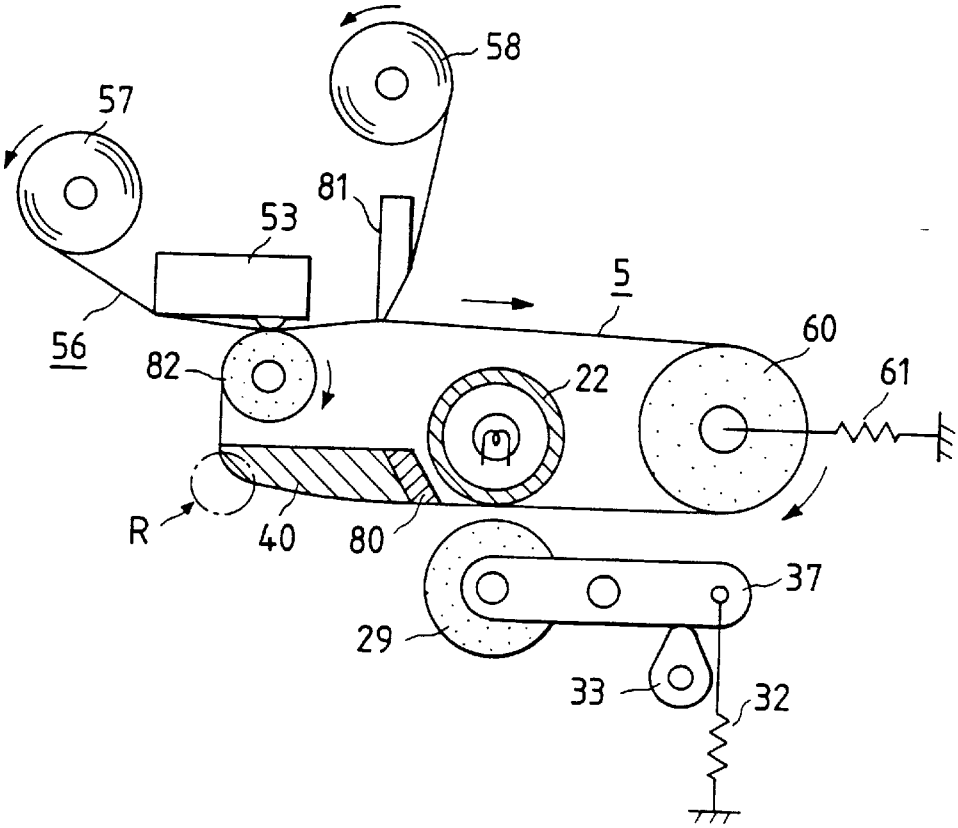
FIG. 27 is a diagram of a thermal transfer printing apparatus according to a sixth embodiment of this invention.

FIG. 27 shows a thermal transfer printing apparatus according to a sixth embodiment of this invention. The thermal transfer printing apparatus of FIG. 27 is similar to the thermal transfer printing apparatus of FIG. 22 except for design changes indicated hereinafter.

The thermal transfer printing apparatus of FIG. 27 includes a belt guide 40 located inside the loop defined by an intermediate medium 5. The belt guide 40 extends in a region between a heating roller 22 and a platen roller 82 associated with a thermal head 53. The platen roller 82 is similar to the platen roller 28 of FIG. 1. The belt guide 40 supports the intermediate medium 5. A rear end of the belt guide 40 has a curved portion "R". A portion of the belt guide 40 between its front and rear ends has a slightly curved surface in engagement with the intermediate medium 5. The belt guide 40 serves as a means for separating the intermediate medium 5 and an image receptor (a picture receptor) 21 from each other.

A cleaning felt 80 is provided on a front end of the belt guide 40. The inner surface of the intermediate medium 5 slides on the cleaning felt 80 during movement of the intermediate medium 5. The belt guide 40 and the cleaning felt 80 compose a means for cleaning the inner surface of the intermediate medium 5.

The thermal transfer printing apparatus of FIG. 27 includes a releasing blade 81 which is similar to the releasing blade 78 of FIG. 17.

Figure 28:
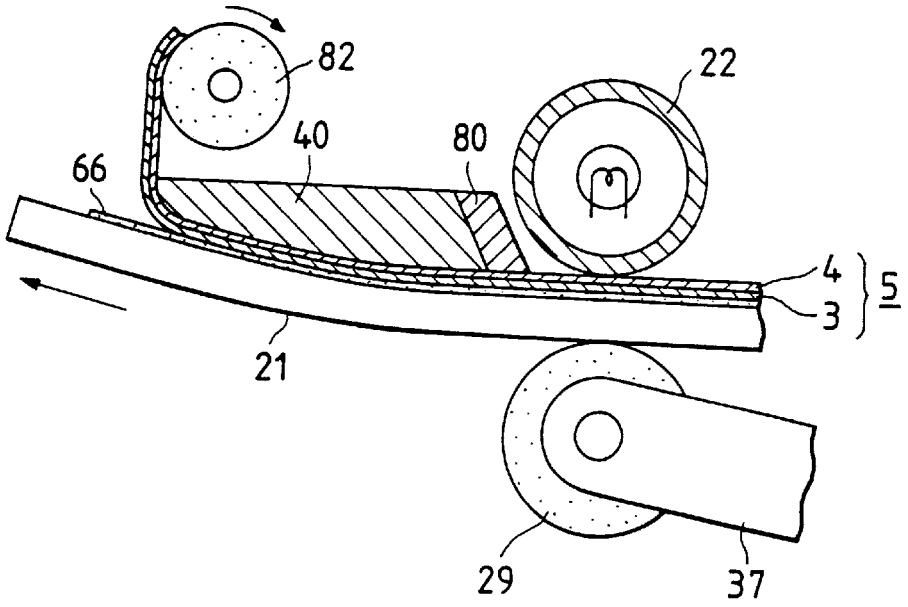
FIG. 28 is a diagram of a portion of the thermal transfer printing apparatus of FIG. 27 in conditions which occur during a transferring process.

FIG. 28 shows an example of conditions of a portion of the thermal transfer printing apparatus which occur during a transferring process. The transferring process follows a recorded-picture forming process.

With reference to FIG. 28, during the transferring process, an opposed roller 29 is pressed against the heating roller 22 via the intermediate medium 5. The intermediate medium 5 and the image receptor 21 are driven through a region between the opposed roller 29 and the heating roller 22 while a color developing layer 66 on the intermediate medium 5 is in contact with the image receptor 21. The color developing layer 66 on the intermediate medium 5 has a full color recorded picture. The image receptor 21 includes a plain paper such as a PPC sheet or a postcard. After the intermediate medium 5 passes the heating roller 22, the intermediate medium 5 travels along the belt guide 40. As the intermediate medium 5 moves along the curved portion "R" of the belt guide 40, the intermediate medium 5 separates from the image receptor 21. During the transferring process, the full color recorded picture is transferred and fixed onto the image receptor 21. Provided that a tension spring 61 (see FIG. 27) applies a suitable tension to the intermediate medium 5, the slightly curved surface of the belt guide 40 suppresses or prevents waves of the intermediate medium 5 which might be developed in a region following the heating roller 22.

The thermal transfer printing apparatus of FIG. 27 has the following features. The belt guide 40 having the curved portion "R" enables a reduced number of parts of the apparatus. The curved portion "R" of the belt guide 40 can have a large curvature which enables easy separation between the intermediate medium 5 and the image receptor 21.

During movement of the intermediate medium 5. the cleaning felt 80 catches dust and foreign matter on the inner surface of the intermediate medium 5 and thereby cleans the inner surface of the intermediate medium 5.

The thermal transfer printing apparatus of FIG. 27 may be provided with a suitable device for removing accumulated dust and foreign matter from the cleaning felt 80. The cleaning felt 80 may be replaced by a cleaning device of a scraper type. The belt guide 40 may have the function of removing dust and foreign matter from the inner surface of the intermediate medium 5.

Other Embodiments and Modifications

While the yellow dye layer, the magenta dye layer, and the cyan dye layer are sequentially arranged in that order in the first, second, third, fourth, fifth, and sixth embodiments, these layers may be arranged in other orders.

The first, second, third, and fourth embodiments may be modified into structures having dye layer transfer sheets provided with a yellow dye layer, a magenta dye layer, and a cyan dye layer respectively.

In the fifth and sixth embodiments, the transfer sheet 56 may be divided into a color developing layer transfer sheet having a color developing layer and a dye layer transfer sheet having dye layers. In this case, dye layer transfer sheets may be used which have a yellow dye layer, a magenta dye layer, and a cyan dye layer respectively.

The thermal heads 1, 41, and 53 may be replaced by electrically-powered recording heads or optical heads. The color developing layer forming means may include a heating roller or a flat-configuration heater other than the thermal head.

In the third, fourth, and sixth embodiments, the releasing blades 77, 78, 79, and 81 support the dye layer transfer sheet 43, the color developing layer transfer sheet 26, and the transfer sheet 56 at positions separate from the normal path of the intermediate medium 5. The releasing blades 77, 78, 79, and 81 may support the dye layer transfer sheet 43, the color developing layer transfer sheet 26, and the transfer sheet 56 at positions adjoining or contacting the-normal path of the intermediate medium 5.

Figure 29:
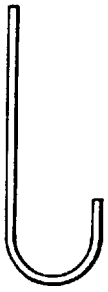
FIG. 29 is a side view of a first modified releasing blade.
Figure 30:
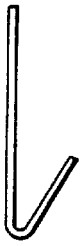
FIG. 30 is a side view of a second modified releasing blade.
Figure 31:
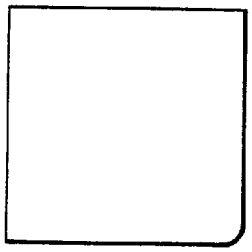
FIG. 31 is a side view of a third modified releasing blade.

In the first and third embodiments, the releasing blades 42 and 77 may be modified into a curved plate of FIG. 29, a bent plate of FIG. 30, or a block of FIG. 31.

Figure 32:
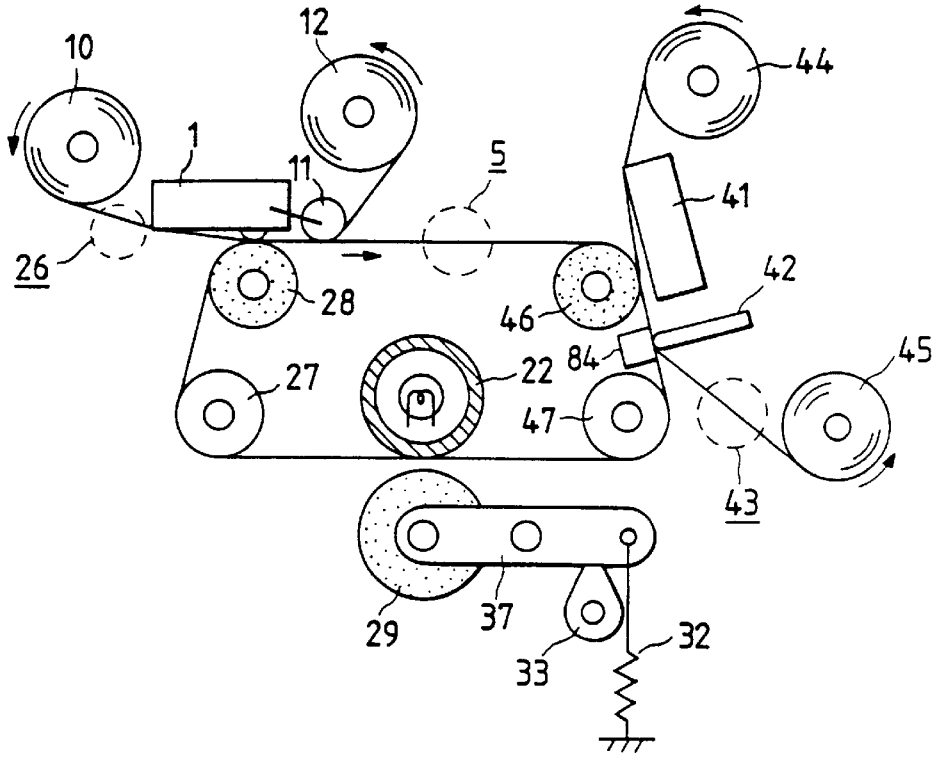
FIG. 32 is a diagram of a modified thermal transfer printing apparatus.

The thermal transfer printing apparatus of FIG. 1 may be modified into a thermal transfer printing apparatus of FIG. 32 which additionally includes a belt support member 84 associated with a releasing blade 42. The belt support member 84 adjoins or contacts the normal path of an intermediate medium 5. As in the second and fifth embodiments, the belt support member 84 may have a curved portion which supports the intermediate medium 5 along an outwardly-projecting plane.

Figure 33:
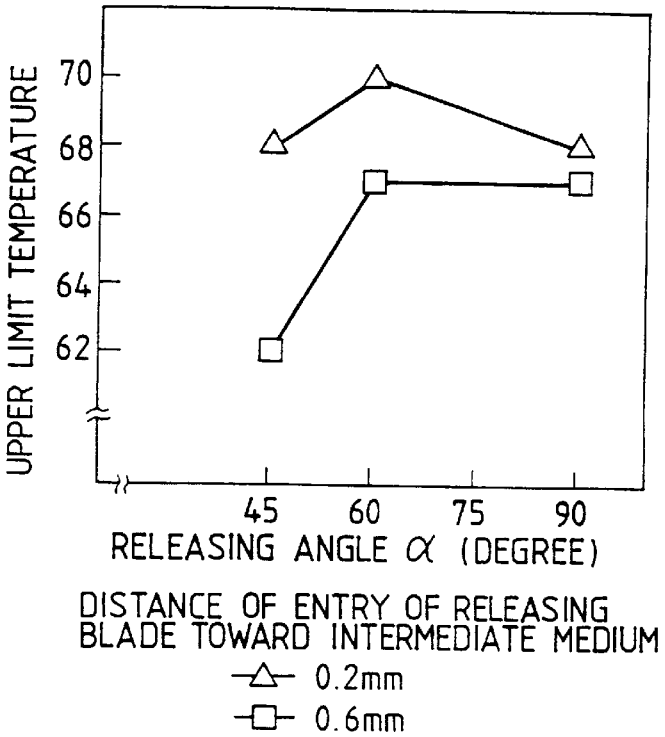
FIG. 33 is a diagram of the experimentally-determined relation between a releasing angle "$\alpha$" and an upper limit temperature at which a dye layer transfer sheet stably separates from an intermediate medium.

In the second, fourth, fifth, and sixth embodiments, it is preferable that the releasing angle "α" is greater. For example, the releasing angle "α" is preferably equal to or greater than 45 degrees. In addition, the releasing angle "α" is preferably in the range between 45 degrees and 90 degrees. The releasing angle "α" is most preferably equal to or greater than 60 degrees. In addition, the releasing angle "α" is most preferably in the range between 60 degrees and 90 degrees. In respect of the second embodiment, FIG. 33 shows the experimentally-determined relation between the releasing angle "α" and an upper limit temperature at which the dye layer transfer sheet 43 stably separates from the intermediate medium 5. The relation in FIG. 33 is provided at each of two different distances, that is, 0.2 mm and 0.6 mm, by which the releasing blade 73 or 75 enters the color developing layer transfer sheet 26 or the dye layer transfer sheet 43 toward the intermediate medium 5. The above-indicated preferable ranges of the releasing angle "α" are decided in view of FIG. 33.

Figure 34:
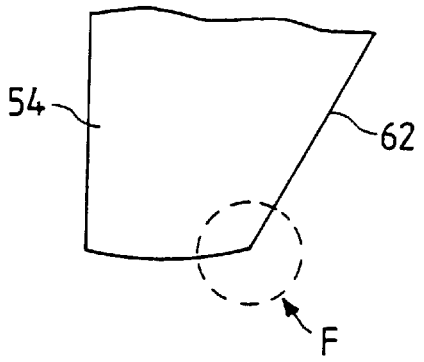
FIG. 34 is a side view of a fourth modified releasing blade.
Figure 35:
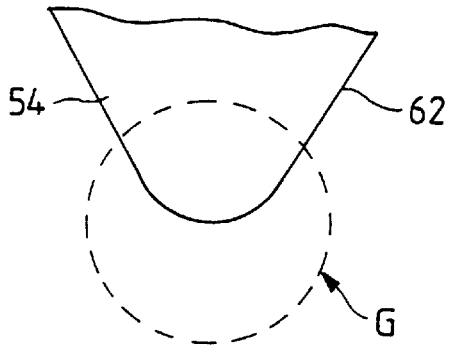
FIG. 35 is a side view of a fifth modified releasing blade.

In the releasing blade 54, 73, 75, 78, 79, or 81, the flat inclination surface 62 may be modified into a slightly-curved surface along which the transfer sheet 56, the color developing layer 26, or the dye layer transfer sheet 43 easily travel. Also, the releasing blade 54, 73, 75, 78, 79, or 81 may be modified into a configuration of FIG. 34 which has a curved surface contacting with the transfer sheet 56, the color developing layer 26, or the dye layer transfer sheet 43. In this case, as shown in FIG. 34, the curved surface and a flat inclined surface 62 meet at a corner "F". Alternatively, the releasing blade 54, 73, 75, 78, 79, or 81 may be modified into a configuration of FIG. 35 which has a curved end corner "G". It is preferable that the corners "D", "F", and "G" have a curvature radius of 1 mm or less.

The urging devices for the releasing blades 42, 54, 73, 75, 77, 78, 79, and 81 may be separate from the urging devices for the thermal heads 1, 41, and 53. The urging devices for the releasing blades 42, 54, 73, 75, 77, 78, 79, and 81 may be common to the urging devices for the thermal heads 1, 41, and 53. It is preferable that the urging devices for the releasing blades 42, 54, 73, 75, 77, 78, 79, and 81 hold them at given positions during the color developing layer forming process and the picture recording process.

Figure 36:
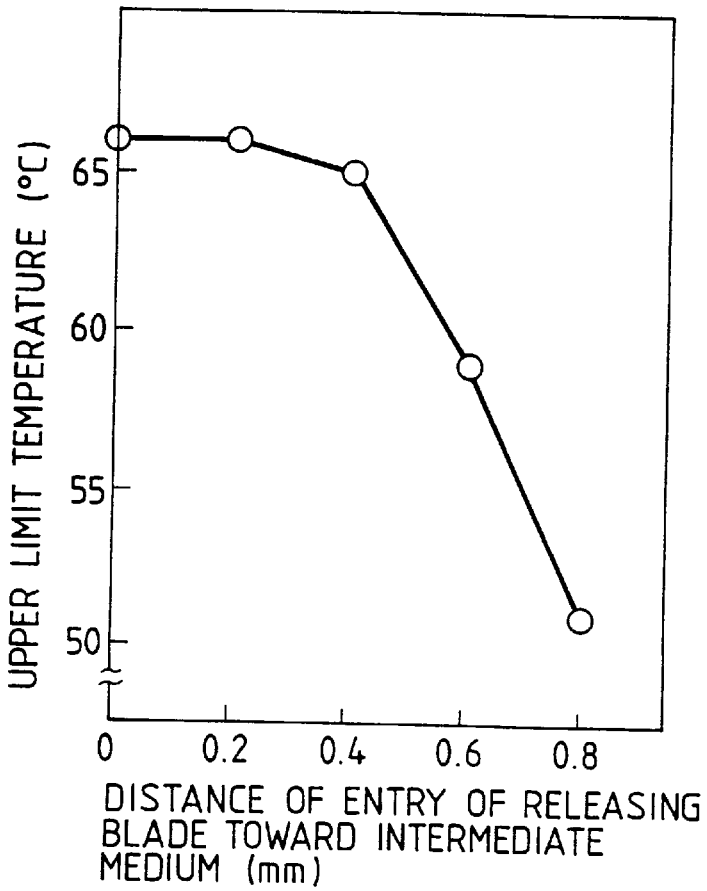
FIG. 36 is a diagram of the experimentally-determined relation between an upper limit temperature and a distance by which a releasing blade enters toward an intermediate medium.

It is preferable that when the releasing blades 42, 54, 73, and 75 are pressed by the urging devices, the releasing blades 42, 54, 73, and 75 enter the normal places of the color developing layer transfer sheet 26, the dye layer transfer sheet 43, and the transfer sheet 56 toward the intermediate medium 5 by a distance of about 0.5 mm. FIG. 36 shows the experimentally-determined relation between an upper limit temperature at which the color developing layer transfer sheet 26, the dye layer transfer sheet 43, or the transfer sheet 56 stably separates from the intermediate medium 5, and the distance by which the releasing blade 42, 54, 73, or 75 enters the color developing layer transfer sheet 26, the dye layer transfer sheet 43, or the transfer sheet 56 toward the intermediate medium 5. The above-indicated distance, 0.5 mm, is decided in view of FIG. 36. It is preferable that the resilient layers 71 of the belt support members 55, 74, and 76 have a relatively high hardness.

In the second and fifth embodiments, the resilient layers 71 may be omitted from the belt support members 55, 74, and 76. In addition, the slipping layers 72 may also be omitted from the belt support members 55, 74, and 76.

In the first embodiment, a resilient layer may be provided on the surface of the second guide roller 47.

Cooling devices such as cooling fans may be provided among the thermal heads 1, 41, and 53 and the releasing blades 42, 54, 73, 75, 77, 78, 79, and 81 to lower the temperatures of the dye later transfer sheet 43 and the transfer sheet 56 at the releasing points. In addition, cooling devices may be provided to cool the releasing blades 42, 54, 73, 75, 77, 78, 79, and 81 and the belt support members 47, 55, 74, and 76.

Figure 37:
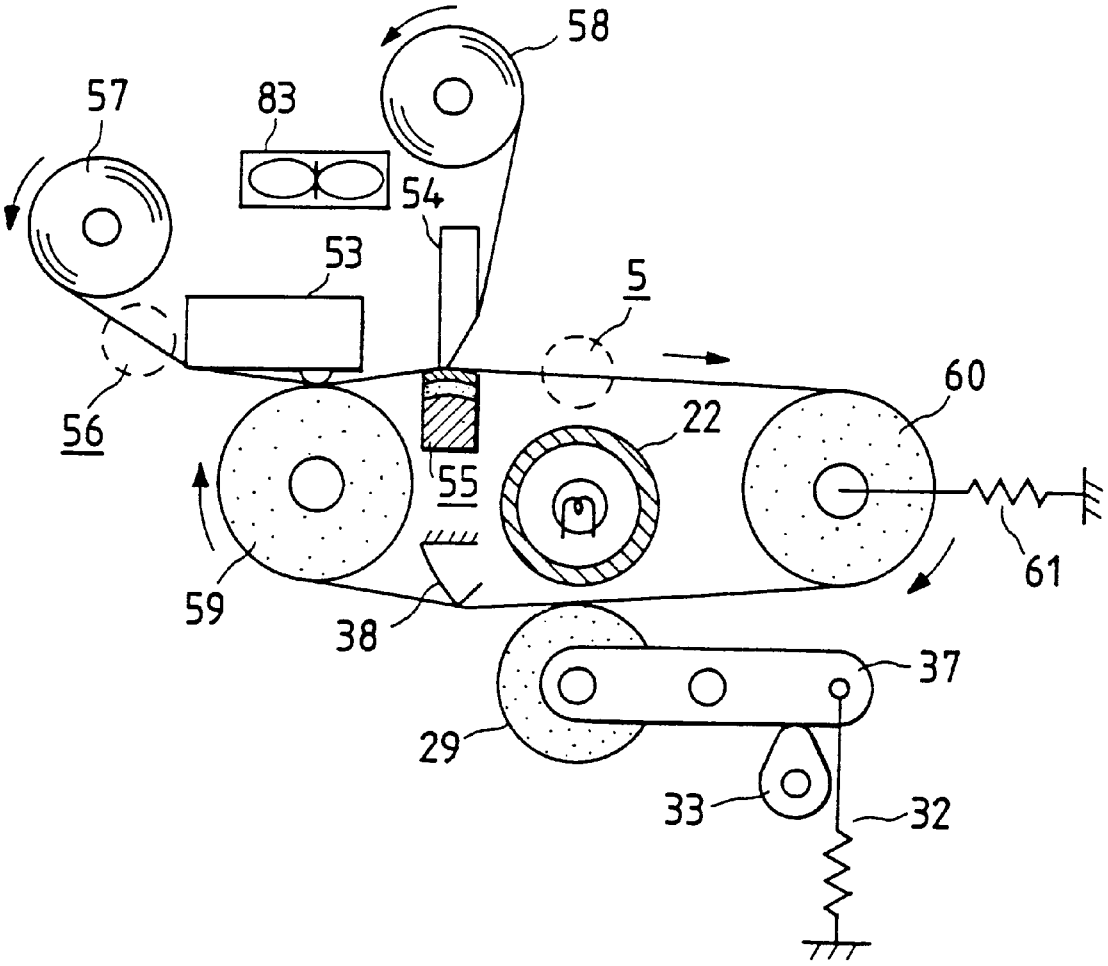
FIG. 37 is a diagram of a modified thermal transfer printing apparatus.

The thermal transfer printing apparatus of FIG. 22 may be modified into a thermal transfer printing apparatus of FIG. 37 which additionally includes a fan 83 located above a thermal head 53. The fan 83 serves to cool the thermal head 53, an intermediate medium 5, a releasing blade 54, and a belt support member 55.

The belt guides 34, 35, 36, 38, and 40 may be modified into other structures.

The combination of the transfer sheet releasing means and the transferring means is not limited to those in the previously-mentioned embodiments.

The heating roller 22 may be replaced by a bar-shaped heater or a heating body provided on a ceramic base. The opposed roller 29 may be fixed. In this case, the heating roller 22 is modified into a structure which can be displaced toward and away from the opposed roller 29, and the heating roller 22 is connected to a suitable urging device.

The heating roller 22 and the opposed roller 29 may be exchanged in position so that the heating roller 22 and the opposed roller 29 will extend outward and inward of the loop of the intermediate medium 5 respectively.

In the first and third embodiments, the cooling roller 11 may be replaced by a cooling plate having an end surface which contacts the color developing layer transfer sheet 26. The cooling roller 11 may be replaced by a cooling block which guides the color developing layer transfer sheet 26 in a region between the thermal head 1 and the releasing point.

Each of the base films 24, 49, and 64 is preferably selected from one of a film of polyester, a film of polystyrene, a film of polypropylene, a film of polysulfone acid, a film of aromatic polyamide, and a film of polyimide.

The color developing layers 9 and 66 may be made of various types of thermoplastic resin or various types of thermosetting resin. The color developing layers 9 and 66 are preferably made of vinyl resin such as polyvinyl acetate, or chloroethylene-vinyl acetate copolymer, polyvinyl acetal resin such as polyvinyl formal, polyvinyl butyral, acetoacetalized polyvinyl alcohol, or propionic acetalized polyvinyl acetal, styrene-acrylonitrile copolymer resin, chloroethylene-acrylic copolymer resin, polyacrylamide resin, or polyester resin such as saturated polyester. In view of less fusion with the dye layers during the picture recording process and a suitable adhesive force with the surface layer 3 of the intermediate medium 5, it is preferable that the color developing layers 9 and 66 contain polyvinyl acetal resin.

It is preferable that the surface layer 3 of the intermediate medium 5 has suitable adhesiveness with the color developing layer 9 or 66. The surface layer 3 of the intermediate medium 5 is preferably made of material which enables easy transfer onto the image receptor 21. The surface layer 3 of the intermediate medium 5 is most preferably made of material containing fluorine rubber, silicone rubber, or fluorosilicone rubber. The thickness of the surface layer 3 of the intermediate medium 5 is preferably equal to or greater than 10 $\mu$m.

The endless belt 4 of the intermediate medium 5 may include a film other than the polyimide film. The intermediate medium 5 may be modified into a structure including an endless belt, and a sheet attached to the endless belt and having a combination of an endless film and a surface layer 3. The intermediate medium 5 may also be modified into a structure including an endless belt, and a sheet attached to the endless belt and having only a surface layer 3. The endless belt 4 of the intermediate medium 5 is of a seamless type or a type having a seam.

What is claimed is:

1. A thermal printing apparatus for printing a recorded picture on an image receptor, comprising:

an intermediate medium having an endless shape;

a color developing layer transfer member including a first base member and a color developing layer on a surface of the first base member;

a dye layer transfer member including a second base member and a dye layer on a surface of the second base member, the dye layer containing dye;

first means for transferring at least a part of the color developing layer from the color developing layer transfer member onto the intermediate medium in response to at least one of heat and pressure;

second means for transferring the dye from the dye layer of the dye layer transfer member onto the color developing layer on the intermediate medium to form a recorded picture on the color developing layer in response to both heat and pressure while contacting the dye layer on the dye layer transfer member and the color developing layer on the intermediate medium with each other;

third means for transferring the color developing layer with the recorded picture from the intermediate medium onto the image receptor; and fourth means, located at a place downstream of the first means as viewed in a direction of movement of the intermediate medium, for implementing separation between the intermediate medium and the color developing layer transfer member;

wherein the fourth means comprises a releasing blade and a belt support member associated with the releasing blade, the releasing blade engaging the color developing layer transfer member, the belt support member supporting the intermediate medium along an outwardly projecting plane; and wherein the releasing blade has a corner contacting with, and the belt support member has a curved surface which supports the intermediate medium along an outwardly-projecting plane.

2. The thermal printing apparatus of claim 1, wherein the releasing blade has a flat portion adjoining the corner and guiding the color developing layer transfer member at a given releasing angle from the intermediate medium, the given releasing angle being in a range between 45 degrees and 90 degrees.

3. The thermal printing apparatus of claim 1, wherein the releasing blade is located at a position which enters a normal place of the color developing layer transfer member toward the intermediate medium by a distance of 0.5 mm. when the recorded picture is formed on the color developing layer.

4. The thermal printing apparatus of claim 1, wherein the belt support member includes a resilient member.

5. The thermal printing apparatus of claim 1, wherein the belt support member is fixed and has a contacting surface on which the intermediate medium slides.

6. The thermal printing apparatus of claim 1, wherein the intermediate medium includes an endless belt and a surface layer provided on an outer surface of the endless belt, the endless belt being made of polyimide, the surface layer being made of fluorine rubber.

7. The thermal printing apparatus of claim 1, wherein the first means and the second means are common.

8. The thermal printing apparatus of claim 1, wherein the releasing blade has a flat portion adjoining the corner and guiding the color developing layer transfer member at a given releasing angle from the intermediate medium, the given releasing angle being in a range between 60 degrees and 90 degrees.

9. A thermal printing apparatus for printing a recorded picture on an image receptor, comprising:

an intermediate medium having an endless shape;

a color developing layer transfer member including a first base member and a color developing layer on a surface of the first base member;

a dye layer transfer member including a second base member and a dye layer on a surface of the second base member, the dye layer containing dye;

first means for transferring at least a part of the color developing layer from the color developing layer transfer member onto the intermediate medium in response to at least one of heat and pressure;

second means for transferring the dye from the dye layer of the dye layer transfer member onto the color developing layer on the intermediate medium to form a recorded picture on the color developing layer in response to both heat and pressure while contacting the dye layer on the dye layer transfer member and the color developing layer on the intermediate medium with each other;

third means for transferring the color developing layer with the recorded picture from the intermediate medium onto the image receptor; and fourth means, located at a place downstream of the first means as viewed in a direction of movement of the intermediate medium, for implementing separation between the intermediate medium and the color developing layer transfer member;

wherein the fourth means comprises a releasing blade which supports the color developing layer transfer member at a position between two guide members supporting the intermediate medium.

10. The thermal printing apparatus of claim 9, wherein the releasing blade has a corner contacting with the color developing layer transfer member.

11. The thermal printing apparatus of claim 10, wherein the releasing blade has a flat portion adjoining the corner and guiding the color developing layer transfer member at a given releasing angle from the intermediate medium, the given releasing angle being in a range between 45 degrees and 90 degrees.

12. The thermal printing apparatus of claim 10, wherein the releasing blade has a flat portion adjoining the corner and guiding the color developing layer transfer member at a given releasing angle from the intermediate medium, the given releasing angle being in a range between 60 degrees and 90 degrees.

13. The thermal printing apparatus of claim 9, wherein the intermediate medium includes an endless belt and a surface layer provided on an outer surface of the endless belt, the endless belt being made of polyimide, the surface layer being made of fluorine rubber.

14. The thermal printing apparatus of claim 9, wherein the first means and the second means are common.

15. A thermal printing apparatus for printing a recorded picture on an image receptor, comprising:

an intermediate medium having an endless shape;

a color developing layer transfer member including a first base member and a color developing layer on a surface of the first base member;

a dye layer transfer member including a second base member and a dye layer on a surface of the second base member, the dye layer containing dye;

first means for transferring at least a part of the color developing layer from the color developing layer transfer member onto the intermediate medium in response to at least one of heat and pressure;

second means for transferring the dye from the dye layer of the dye layer transfer member onto the color developing layer on the intermediate medium to form a recorded picture on the color developing layer in response to both heat and pressure while contacting the dye layer on the dye layer transfer member and the color developing layer on the intermediate medium with each other; and third means for transferring the color developing layer with the recorded picture from the intermediate medium onto the image receptor;

wherein the third means comprises:

a) a pair of a heating roller and an opposed roller located at inner and outer sides of the intermediate medium respectively;

b) fourth means for pressing at least one of the heating roller and the opposed roller against the other via the intermediate medium and the image receptor;

c) fifth means for separating the image receptor from the intermediate medium; and d) sixth means located between a location of the pair of the heating roller and the opposed roller and a location of the fifth means for suppressing waves of the intermediate medium, the sixth means including a belt guide which guides and supports the intermediate medium.

16. The thermal printing apparatus of claim 15, wherein the belt guide is located at an inner side of the intermediate medium and is relatively pressed against the intermediate medium.

17. The thermal printing apparatus of claim 15, wherein a direction of path of travel of the intermediate medium changes at a position between the heating roller and the opposed roller, and a line connecting centers of the heating roller and the opposed roller is approximately perpendicular to a direction of travel of the intermediate medium in a region following the location of the pair of the heating roller and the opposed roller.

18. The thermal printing apparatus of claim 15, wherein the belt guide and the fifth means are in a single body.

19. The thermal printing apparatus of claim 15, wherein the belt guide comprises means for cooling the intermediate medium.

20. The thermal printing apparatus of claim 15, wherein the belt guide comprises means for cleaning the intermediate medium.

21. The thermal printing apparatus of claim 15, wherein the intermediate medium includes an endless belt and a surface layer provided on an outer surface of the endless belt, the endless belt being made of polyimide, the surface layer being made of fluorine rubber.

22. The thermal printing apparatus of claim 15, wherein the first means and the second means are common.

23. A thermal printing apparatus for printing a recorded picture on an image receptor, comprising:

an intermediate medium having an endless shape;

a color developing layer transfer member including a first base member and a color developing layer on a surface of the first base member;

a dye layer transfer member including a second base member and a dye layer on a surface of the second base member, the dye layer containing dye;

first means for transferring at least a part of the color developing layer from the color developing layer transfer member onto the intermediate medium in response to at least one of heat and pressure;

second means for transferring the dye from the dye layer of the dye layer transfer member onto the color developing layer on the intermediate medium to form a recorded picture on the color developing layer in response to both heat and pressure while contacting the dye layer on the dye layer transfer member and the color developing layer on the intermediate medium with each other;

third means for transferring the color developing layer with the recorded picture from the intermediate medium onto the image receptor; and fourth means, located at a place downstream of the second means as viewed in a direction of movement of the intermediate medium, for implementing separation between the intermediate medium and the dye layer transfer member;

wherein the fourth means comprises a releasing blade and a belt support member associated with the releasing blade, the releasing blade engaging the dye layer transfer member, the belt support member supporting the intermediate medium along an outwardly-projecting plane; and wherein the releasing blade has a corner contacting with the dye layer transfer member, and the belt support member has a curved surface which supports the intermediate medium along an outwardly projecting plane.

24. The thermal printing apparatus of claim 23, wherein the releasing blade has a flat portion adjoining the corner and guiding the dye layer transfer member at a given releasing angle from the intermediate medium, the given releasing angle being in a range between 45 degrees and 90 degrees.

25. The thermal printing apparatus of claim 23, wherein the releasing blade has a flat portion adjoining the corner and guiding the dye layer transfer member at a given releasing angle from the intermediate medium, the given releasing angle being in a range between 60 degrees and 90 degrees.

26. The thermal printing apparatus of claim 23, wherein the releasing blade is located at a position which enters a normal place of the dye layer transfer member toward the intermediate medium by a distance of 0.5 mm when the recorded picture is formed on the color developing layer.

27. The thermal printing apparatus of claim 23, wherein the belt support member includes a resilient member.

28. The thermal printing apparatus of claim 23, wherein the belt support member is fixed and has a contacting surface on which the intermediate medium slides.

29. The thermal printing apparatus of claim 23, wherein the intermediate medium includes an endless belt and a surface layer provided on an outer surface of the endless belt, the endless belt being made of polyimide, the surface layer being made of fluorine rubber.

30. The thermal printing apparatus of claim 23, wherein the first means and the second means are common.

31. A thermal printing apparatus for printing a recorded picture on an image receptor, comprising:

an intermediate medium having an endless shape;

a color developing layer transfer member including a first base member and a color developing layer on a surface of the first base member;

a dye layer transfer member including a second base member and a dye layer on a surface of the second base member, the dye layer containing dye;

first means for transferring at least a part of the color developing layer from the color developing layer transfer member onto the intermediate medium in response to at least one of heat and pressure;

second means for transferring the dye from the dye layer of the dye layer transfer member onto the color developing layer on the intermediate medium to form a recorded picture on the color developing layer in response to both heat and pressure while contacting the dye layer on the dye layer transfer member and the color developing layer on the intermediate medium with each other;

third means for transferring the color developing layer with the recorded picture from the intermediate medium onto the image receptor; and fourth means, located at a place downstream of the second means as viewed in a direction of movement of the intermediate medium, for implementing separation between the intermediate medium and the dye layer transfer member;

wherein the fourth means comprises a releasing blade which supports the dye layer transfer member at a position between two guide members supporting the intermediate medium.

32. The thermal printing apparatus of claim 31, wherein the releasing blade has a corner contacting with the dye layer transfer member.

33. The thermal printing apparatus of claim 32, wherein the releasing blade has a flat portion adjoining the corner and guiding the dye layer transfer member at a given releasing angle from the intermediate medium, the given releasing angle being in a range between 45 degrees and 90 degrees.

34. The thermal printing apparatus of claim 32, wherein the releasing blade has a flat portion adjoining the corner and guiding the dye layer transfer member at a given releasing angle from the intermediate medium, the given releasing angle being in a range between 60 degrees and 90 degrees.

35. The thermal printing apparatus of claim 31, wherein the intermediate medium includes an endless belt and a surface layer provided on an outer surface of the endless belt, the endless belt being made of polyimide, the surface layer being made of fluorine rubber.

36. The thermal printing apparatus of claim 31, wherein the first means and the second means are common.

* * * * *